US007338919B2

(12) United States Patent
Kawahara et al.

(10) Patent No.: US 7,338,919 B2
(45) Date of Patent: Mar. 4, 2008

(54) REVERSIBLE THERMOSENSITIVE RECORDING MEDIUM AND DEVICE, AND IMAGE PROCESSING METHOD AND APPARATUS USING THE REVERSIBLE THERMOSENSITIVE RECORDING MEDIUM

(75) Inventors: Shinya Kawahara, Numazu (JP); Kunio Hayakawa, Mishima (JP); Hitoshi Shimbo, Shizuoka-ken (JP)

(73) Assignee: Ricoh Company, Ltd., Tokyo (JP)

( * ) Notice: Subject to any disclaimer, the term of this patent is extended or adjusted under 35 U.S.C. 154(b) by 404 days.

(21) Appl. No.: 11/071,524

(22) Filed: Mar. 2, 2005

(65) Prior Publication Data

US 2005/0197250 A1 Sep. 8, 2005

(30) Foreign Application Priority Data

Mar. 3, 2004 (JP) ..... 2004-059848

(51) Int. Cl.
*B41M 5/30* (2006.01)

(52) U.S. Cl. ..... 503/201; 503/216

(58) Field of Classification Search ..... None
See application file for complete search history.

(56) References Cited

U.S. PATENT DOCUMENTS

| | | | | |
|---|---|---|---|---|
| 5,306,687 | A | 4/1994 | Furuya et al. | |
| 5,407,890 | A | 4/1995 | Ishikawa | |
| 5,447,900 | A | 9/1995 | Suzaki et al. | |
| RE35,640 | E * | 10/1997 | Hotta et al. | 503/200 |
| 6,180,560 | B1 | 1/2001 | Hayakawa et al. | |
| 6,261,992 | B1 * | 7/2001 | Furuya et al. | 503/201 |
| 6,710,015 | B2 | 3/2004 | Kaneko et al. | |
| 6,747,170 | B2 | 6/2004 | Hayakawa et al. | |
| 2003/0153460 | A1 | 8/2003 | Morita et al. | |
| 2004/0242414 | A1 | 12/2004 | Morita et al. | |
| 2005/0014645 | A1 | 1/2005 | Shimbo et al. | |

FOREIGN PATENT DOCUMENTS

| | | |
|---|---|---|
| JP | 55-154198 | 12/1980 |
| JP | 02-188293 | 7/1990 |
| JP | 02-188294 | 7/1990 |
| JP | 03-169590 | 7/1991 |

(Continued)

OTHER PUBLICATIONS

Patent Abstracts of Japan, vol. 1996, No. 08, Aug. 30, 1996, abstract of JP 08 085255A (Toppan), Apr. 2, 1996.

(Continued)

*Primary Examiner*—Bruce H. Hess
(74) *Attorney, Agent, or Firm*—Cooper & Dunham LLP

(57) ABSTRACT

A reversible thermosensitive recording medium including a substrate; and a reversible thermosensitive recording layer located on the substrate and reversibly achieving a relatively colored state and a relatively discolored state depending on the temperature to which the recording layer is heated or the cooling speed at which the recording layer is cooled after heating, wherein the reversible thermosensitive recording layer comprises a polyalkylene glycol compound having a number average molecular weight not less than 2,000 exclusive of polypropylene glycol having a number average molecular weight not greater than 5,000. A reversible thermosensitive recording device, and an image processing method and apparatus using the reversible thermosensitive recording medium are also be provided.

21 Claims, 10 Drawing Sheets

FOREIGN PATENT DOCUMENTS

| | | |
|---|---|---|
| JP | 04-224996 | 8/1992 |
| JP | 04-247985 | 9/1992 |
| JP | 04-267190 | 9/1992 |
| JP | 08-085255 | 4/1996 |
| JP | 08-108627 | 4/1996 |
| JP | 10-067177 | 3/1998 |
| JP | 10-119440 | 5/1998 |

OTHER PUBLICATIONS

Patent abstracts of Japan, vol. 013, No. 394(c-631), Aug. 31, 1989, abstract of JP 01 138274A (Agency of Ind.) May 31, 1989.
European Patent Office, Communication Pursuant to Article 96(2) EPC dated Feb. 2, 2007 in European Patent Application No. 05 004 589.7—1251 (Ricoh Company, Ltd.).
U.S. Appl. No. 11/015,960, filed Dec. 17, 2004, Hayakawa et al.
U.S. Appl. No. 09/689,523, filed Dec. 12, 2000, Hayakawa et al.

* cited by examiner

FRONT SIDE

BACK SIDE

REVERSIBLE THERMOSENSITIVE RECORDING MEDIUM AND DEVICE, AND IMAGE PROCESSING METHOD AND APPARATUS USING THE REVERSIBLE THERMOSENSITIVE RECORDING MEDIUM

BACKGROUND OF THE INVENTION

1. Field of the Invention

The present invention relates to a reversible thermosensitive recording medium in which an image can be reversibly recorded and erased, and a reversible thermosensitive recording device using the thermosensitive recording medium. More particularly, the present invention relates to a reversible thermosensitive recording medium which achieves a relatively colored state or a relatively discolored state utilizing at least one of differences in heating temperature and cooling speed after heating. In addition, the present invention also relates to an image processing method and apparatus using the thermosensitive recording medium.

2. Discussion of the Related Art

Recently, reversible thermosensitive recording media in which an image is recorded, and the recorded image can be erased if desired, attract attention. Among the reversible thermosensitive recording media, a medium in which a color developer, such as organic phosphoric acid compounds, aliphatic carboxylic acid compounds and phenolic compounds, which have a long aliphatic hydrocarbon chain, and a coloring agent such as leuco dyes are dispersed in a resin is well known.

For example, published unexamined Japanese Patent Applications Nos. (hereinafter referred to as JP-A) 10-67177 and 10-119440 have disclosed reversible thermosensitive coloring compositions including an electron accepting compound and a phenolic compound. These reversible thermosensitive coloring compositions have such advantages as to be able to record high-contrast images and erase images at a high speed. In addition, the compositions also have an advantage such that recorded images can be erased with a thermal printhead under normal temperature and normal humidity conditions, and have a potentiality such that overwriting is performed using a thermal printhead. However, the compositions have a drawback in that recorded images cannot be well erased under low temperature and low humidity conditions.

JP-A 08-108627 discloses a reversible thermosensitive recording material in which one or more of adducts of ethylene oxide, propylene oxide or butylene oxide are used as an auxiliary erasing agent. JP-A 08-108627 did not disclose specific information about the molecular weight of the adducts, and an adduct of polyethylene oxide having an average molecular weight less than 2,000 is used for examples of the recording material. In addition, there is no description or suggestion in JP-A 08-108627 as to whether the recording material have an improved erasing property under low temperature/low humidity conditions.

JP-A 08-085255 (i.e., Japanese Patent No. 3,075,101) discloses a reversible thermosensitive recording material using a compound having a polyoxyethylene chain in the molecule thereof as an auxiliary erasing agent. This recording material includes a developing/reducing reagent, which has both an acid group and a basic group in its molecule, an essential material. Namely, the developing controlling agent releases a hydrogen ion when heated to a relatively high temperature, and serves as a base to erase recorded images when heated to a relatively low temperature. This image recording/erasing mechanism is different from the typical reversible thermal image recording/erasing mechanism in which a recording material achieves a colored state or a discolored state utilizing at least one of differences in heating temperature and cooling speed after heating. In addition, JP-A 08-085255 does not disclose information about number average molecular weight of the compounds having a polyoxyethylene chain. Further, JP-A 08-085255 does not disclose or suggest whether the recording material has an improved erasing property under low temperature and low humidity conditions.

Because of these reasons, a need exists for a reversible thermosensitive recording medium which can reversibly record an image having a high image density (i.e., a high contrast) and erase an image at a high speed even under various environmental conditions of from low temperature and low humidity conditions to normal temperature and normal humidity conditions.

SUMMARY OF THE INVENTION

Accordingly, an object of the present invention is to provide a reversible thermosensitive recording medium which can reversibly record an image having a high image density and erase an image at a high speed even under various environmental conditions of from low temperature and low humidity conditions to normal temperature and normal humidity conditions.

In addition, another object of the present invention is to provide a reversible thermosensitive recording device, an image processing apparatus and an image processing method, by which an image having a high image density can be reversibly recorded and erased at a high speed even under various environmental conditions.

Briefly these objects and other objects of the present invention as hereinafter will become more readily apparent can be attained by a reversible thermosensitive recording medium including at least a substrate, and a reversible thermosensitive recording layer which is located overlying the substrate and which reversibly achieves a colored state and a discolored state depending on the temperature or the cooling speed after heating, wherein the reversible thermosensitive recording layer includes a polyalkylene glycol compound having a number average molecular weight not less than 2,000 exclusive of polypropylene glycol having a number average molecular weight not greater than 5,000.

The number average molecular weight of the polyalkylene glycol compound is preferably from 2,000 to 6,000,000, and more preferably 6,000 to 6,000,000, and even more preferably from 15,000 to 6,000,000.

The polyalkylene glycol compound is preferably polyethylene glycol.

It is preferable that at least one end of the polyalkylene glycol compound is substituted with an ether group, an ester group or a urethane group.

The polyalkylene glycol compound is preferably included in the reversible thermosensitive recording layer in an amount of from 0.1 to 50 parts by weight per 100 parts by weight of resin components included in the recording layer.

The reversible thermosensitive recording layer preferably includes an electron donating coloring compound and an electron accepting compound. The electron accepting compound is preferably a phenolic compound having the following formula (1):

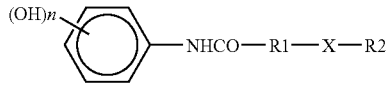

(1)

wherein n represents an integer of from 1 to 3; X represents a divalent group including at least one of a nitrogen atom and an oxygen atom; R1 represents an aliphatic hydrocarbon group having not less than 2 carbon atoms, which is optionally substituted; and R2 represents an aliphatic hydrocarbon group having 1 to 22 carbon atoms.

The group X is preferably a urea group.

The reversible thermosensitive recording layer preferably includes a compound, which has at least one of an amide group, a urethane group and a urea group, a discoloring accelerating agent.

The reversible thermosensitive recording layer preferably includes a crosslinked resin.

The reversible thermosensitive recording medium can be in the form of a card, a label or a sheet. When the medium has a label form, the medium preferably has an adhesive layer on the backside thereof.

As another aspect of the present invention, a reversible thermosensitive recording device is provided which includes an information storage portion and a reversible image displaying portion including the reversible thermosensitive recording medium mentioned above. The information storage portion and the reversible image displaying portion are preferably provided on a material. The information storage portion preferably includes an information storage memory selected from the group consisting of magnetic recording layers, magnetic recording stripes, IC memories, optical memories, RF-ID (Radio Frequency Identification) tag cards, disks, disc cartridges and tape cassettes.

As yet another aspect of the present invention, an image processing apparatus is provided which includes at least one of an image recording device configured to heat the reversible thermosensitive recording medium to record an image therein and an image erasing device configured to heat the reversible thermosensitive recording medium to erase an image therein.

The image recording device is preferably a thermal printhead or a laser irradiating device. The image erasing device is preferably a device selected from the group consisting of thermal printheads, ceramic heaters, heat rollers, hot stamps, heat blocks and laser irradiating devices.

As a further aspect of the present invention, an image processing method is provided which includes at least one of the following steps:

imagewise heating the reversible thermosensitive recording layer in the reversible thermosensitive recording medium mentioned above to form an image in the recording layer; and heating the reversible thermosensitive recording layer to erase an image recorded therein.

The image recording is preferably performed with a thermal printhead or a laser irradiating device. The image erasing is preferably performed with a device selected from the group consisting of thermal printheads, ceramic heaters, heat rollers, hot stamps, heat blocks and laser irradiating devices. The image recording is preferably performed while erasing previously recorded images using a thermal printhead.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
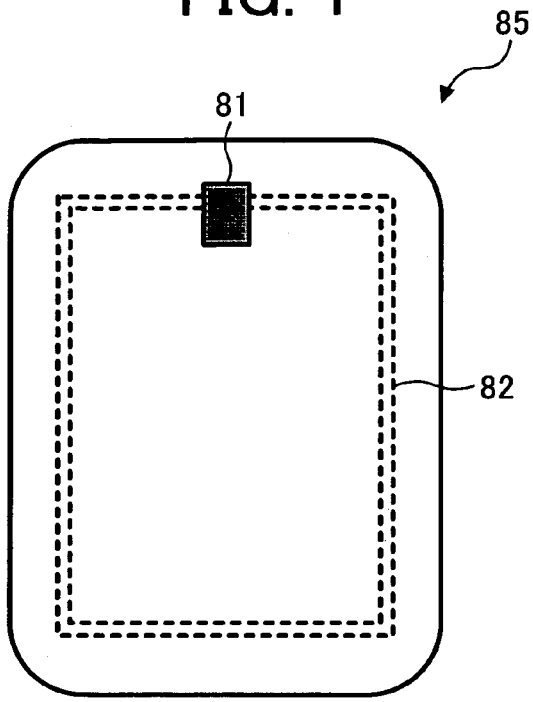
FIG. 1 is a schematic view illustrating an embodiment of the RF-ID tag for use in the reversible thermosensitive recording device of the present invention.

As a result of the present inventors' investigation on the dependence of erasability of a reversible recording medium on environmental temperature and humidity, it is found that by adding a polyalkylene glycol compound having a plurality of ether groups in the molecule thereof to the recording layer, the dependence of erasability on environmental conditions can be reduced while high speed erasability can be maintained. In particular, by using a polyalkylene glycol having a number average molecular weight not less than 2,000, image erasing can be well performed with being hardly influenced by environmental conditions even when a thermal printhead is used as an erasing device. Thus, the present invention is made.

The reversible thermosensitive recording medium of the present invention (hereinafter sometimes referred to as the recording medium) includes at least a substrate, and a thermosensitive recording layer (hereinafter referred to as a recording layer) which is located overlying the substrate and which reversibly changes its color depending on the temperature The recording layer includes a polyalkylene glycol compound having a number average molecular weight not less than 2,000 exclusive of polypropylene glycol compounds having a number average molecular weight not greater than 5,000.

The action of the polyalkylene glycol compounds is considered to be as follows. When such a polyalkylene glycol is included in the recording layer of the recording medium of the present invention, the lone pairs in the ether groups included in the polyalkylene glycol interact with the hydrogen bond group of the color developer, and thereby the color developer and the coloring agent included in the recording layer easily cause phase separation and crystallization of the color developer can be accelerated. As a result, a recording medium in which an image having a high image density can be reversibly recorded and erased at a high speed even under various environmental conditions of from low temperature/low humidity conditions to normal temperature/normal humidity conditions. Namely, the recording medium of the present invention has good practicality in recording and erasing.

One embodiment of the recording medium of the present invention is a label (hereinafter sometimes referred to as a recording label). The recording label of the present invention includes a recording layer, which includes the polyalkylene glycol mentioned above, and an adhesive layer located on a side of the substrate opposite that bearing the recording layer. Since the recording label has an adhesive layer, the label can be attached to various materials such as thick cards, e.g., polyvinyl chloride cards with a magnetic stripe; large-sized containers, stickers and displays; etc., on which the recording layer cannot be formed by a coating method.

The reversible thermosensitive recording device (hereinafter sometimes referred to as the recording device) of the present invention includes an information storage portion and a reversible display portion including the recording medium of the present invention. Therefore, a desired image having high contrast and good visibility can be recorded in the display portion at a desired time. In addition, the image can be erased, if desired. The information storage portion includes a memory such as magnetic recording layers, magnetic stripes, IC memories, optical memories, RF-ID tag cards, disks, disc cartridges, tape cassettes, etc., and information such as character information, image information, and music information can be recorded and erased.

The image processing apparatus of the present invention includes at least one of an image forming device and an image erasing device. The image erasing device heats the recording medium to erase an image previously recorded in the recording medium. The image forming device imagewise heats the recording medium of the present invention to form an image in the recording medium. Since the recording medium of the present invention has high speed erasability under various environmental conditions of from low temperature/low humidity conditions to normal temperature/normal humidity conditions, the image processing apparatus can clearly erase images at a high speed. Namely, the image processing apparatus has good practicality in image recording and erasing.

In the image processing method of the present invention, the recording medium of the present invention is heated to erase a previously recorded image and/or form an image therein. Whether recording or erasing (coloring or discoloring) is performed depends on the temperature of the heated recording layer or the cooling speed after heating the recording layer. Since the recording medium of the present invention has high speed erasability under various environmental conditions of from low temperature/low humidity conditions to normal temperature/normal humidity conditions, images can be clearly erased at a high speed. Namely, the image processing method of the present invention has good practicality in image recording and erasing.

At first, the reversible thermosensitive recording medium of the present invention will be explained in detail. The recording medium of the present invention includes at least a substrate and a recording layer, and optionally includes one or more layer such as an intermediate layer, a protective layer a back layer and other layers.

<Substrate>

The form, structure and dimension of the substrate of the recording medium are not particularly limited, and a proper substrate is used so that the resultant recording medium fits the needs. With respect to the form, substrates having a plate form are typically used. As for the layer structure thereof, substrates having a single-layered structure or a multi-layered structure can be used. The dimension of the substrate is determined depending on the dimension of the recording layer to be formed thereon.

Specific examples of the materials for use in the substrate include inorganic materials such as glass, quartz, silicon, silicon oxide, aluminum oxide, silicone dioxide, and metals; organic materials such as cellulose derivatives (e.g., papers, and cellulose triacetate), synthetic papers, polyethylene terephthalate, polycarbonate, polystyrene, and polymethyl methacrylate. These materials can be used alone or in combination.

It is preferable that the surface of the substrate is subjected to a surface treatment such as corona discharging treatments, oxidation reaction treatments (using chromic acid), etching treatments, adhesion improving treatments, antistatic treatments to improve the adhesion between the substrate and the layer formed thereon and qualities of the coated layer. In addition, it is preferable to include a white material such as white pigments (e.g., titanium oxide) in the substrate to whiten the substrate.

The thickness of the substrate is not particularly limited, and is determined depending on the needs for the recording medium. The thickness is preferably from 50 to 2,000 μm, and more preferably from 100 to 1,000 μm.

The substrate can bear a magnetic layer, which can store information therein, on the same side as and/or the side thereof opposite that bearing the recording layer. In addition, the substrate can have an adhesive layer on the backside thereof so that the recording medium can be adhered to other media or goods.

<Thermosensitive Recording Layer>

The recording layer can reversibly change its color depending on the temperature thereof and includes at least a polyalkylene glycol compound, and preferably includes an electron donating coloring compound, an electron accepting compound, a discoloring accelerating agent and a binder resin. The recording layer can optionally include other components.

Reversible change of color of the recording layer depending on temperature means a phenomenon in that the recording layer reversibly causes a visual change when the temperature is changed, i.e., the recording layer can achieve a relatively colored state and a relatively discolored state when the temperature to which the recording layer is heated or the cooling speed at which the recording layer is cooled after heated is changed. In this regard, the visual change may be a change in color tone or shape. However, in the present invention, materials which cause a change in color tone are preferably used.

Specific examples of changes in color include change in transmittance, reflectance, absorption wavelength (i.e., color tone), scattering coefficient, etc. The present recording medium typically displays an image while utilizing a combination of two or more of these properties. Specifically, any materials which can reversibly change their transmittance or color tone when being heated can be used for the recording layer. For example, materials which can achieve a first colored state when being heated to a first specific temperature higher than normal temperature and which can achieve a second colored state when being heated to a second specific temperature higher than the first specific temperature, followed by cooling can be preferably used.

Specific examples of these materials include a material which is disclosed in JP-A 55-154198 incorporated herein by reference and which-can reversible achieve a transparent state when being heated to a first specific temperature and an opaque state when being heated to a second specific temperature; materials which have been disclosed in JP-As 04-224996, 04-247985 and 04-267190 incorporated herein by reference and which can reversibly achieve a colored state when being heated to a second specific temperature and a discolored state when being heated to a first specific temperature; a material which is disclosed in JP-A 03-169590 incorporated herein by reference and which can reversibly achieve an opaque state when being heated to a first specific temperature and a transparent state when being heated to a second specific temperature; materials which have been disclosed in JP-As 02-188293 and 02-188294 incorporated herein by reference and which can reversibly achieve a colored state (such as black, red or blue colored state) when being heated to a first temperature and a discolored state when being heated to a second specific temperature.

Among these materials, a material including a polyalkylene glycol compound, an electron donating coloring agent (hereinafter sometimes referred to as a coloring agent), an electron accepting agent (hereinafter sometimes referred to as a color developer) is preferably used.

<Polyalkylene Glycol Compound>

Suitable polyalkylene glycol compounds for use in the recording material of the present invention include polyalkylene glycol compounds having a number average molecular weight not less than 2,000 exclusive of polypropylene glycol compounds having a number average molecular weight not greater than 5,000. The number average molecular weight of the polyalkylene glycol compounds is preferably from 2,000 to 6,000,000, more preferably from 6,000 to 6,000,000 and even more preferably from 15,000 to 6,000,000.

When the number average molecular weight is too low, the resultant recording medium has poor erasability under low temperature/low humidity conditions. In contrast, when the number average molecular weight is too high, it becomes difficult to dissolve the compounds in an organic solvent and thereby the compounds cannot be uniformly dispersed or dissolved in a coating liquid, resulting in formation of coating defects in the resultant recording layer.

The number average molecular weight of polyalkylene glycol compounds can be measured by a method such as gel permeation chromatography (GPC).

Specific examples of the polyalkylene glycol compounds include polyethylene glycol, polypropylene glycol (exclusive of polypropylene glycol having a molecular weight not greater than 5,000), polytetramethylene glycol, polyhexamethylene glycol, etc. Among these compounds, polyethylene glycol is preferably used. In addition, copolymers of a polyalkylene glycol having a number average molecular weight of from 2,000 to 6,000,000 (greater than 5,000 and not greater than 6,000,000 for polypropylene glycol) with another compound can also be used.

The polyalkylene glycol compounds can be used alone or in combination.

Polyalkylene glycol compounds which have a group, such as ether groups, ester groups and urethane groups, at one end portion thereof as illustrated in the following formulae (2) to (4) can be used as the polyalkylene glycol compound.

$$RO(C_mH_{2m}O)_nH \quad \text{Formula (2)}$$

$$RCOO(C_mH_{2m}O)_nH \quad \text{Formula (3)}$$

$$RNHCOO(C_mH_{2m}O)_nH \quad \text{Formula (4)}$$

In formulae (2) to (4), R represents an alkyl group, a cycloalkyl group, an aryl group, an aralkyl group, a heterocyclic ring group or a silyl group, which groups may be substituted; and each of m and n is an integer not less than 1.

Specific examples of such polyalkylene glycol compounds include polyethylene glycol monooleyl ethers, polyethylene glycol monostearic acid esters, etc.

The content of the polyalkylene glycol compound in the recording layer is determined depending on the materials used for the recording layer, but is typically from 0.1 to 50 parts by weight and preferably from 1 to 50 parts by weight per 100 parts by weight of the resin components included in the recording layer. When the content is too low, the resultant recording medium has poor erasability under low temperature/low humidity conditions. In contrast, when the content is too high, the color density of the colored state tends to decrease.

<Electron Accepting Compound>

Any known electron accepting compounds which can reversibly perform coloring and discoloring when being heated can be used as a color developer. Suitable compounds for use as the electron accepting compound include compounds which have both a first portion capable of coloring an electron donating compound (i.e., developing a coloring agent), such as a phenolic hydroxyl group, a carboxyl group and a phosphate group, and a second portion capable of controlling cohesive force in the molecule thereof, such as groups in which long chain hydrocarbon groups are connected with each other. The connection part in the second portion capable of controlling cohesive force can include a polyvalent group including a hetero atom. In addition, the long chain hydrocarbon groups in the second portion may include such a connection part and/or an aromatic group. Among these compounds, phenolic compounds having an alkyl chain which have the following formula (1) are preferably used as the electron accepting compound.

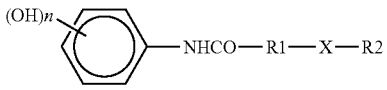

(1)

In formula (1), n represents an integer of from 1 to 3; X represents a divalent group including at least one of a nitrogen atom and an oxygen atom; $R_1$ represents an aliphatic hydrocarbon group having not less than 2 carbon atoms, which is optionally substituted; and R2 represents an aliphatic hydrocarbon group having 1 to 22 carbon atoms.

In formula (1), the number of carbon atoms included in the group R2 is preferably from 8 to 18. The group X is preferably an amide group or a urea group, and more preferably a urea group. The group R1 is preferably an aliphatic hydrocarbon group having not less than 5 carbon atoms.

In formula (1), the hydrocarbon groups may be linear or branched, and can include an unsaturated bond. Specific examples of the substituents connected to the hydrocarbon groups include hydroxyl groups, halogen atoms, alkoxyl groups, etc. The total number of carbon atoms included in the groups R1 and R2 is preferably not less than 8, and more preferably not less than 11, in order to impart good coloring stability and good erasability to the resultant recording medium.

Specific examples of the groups for use as the group R1 include the following:

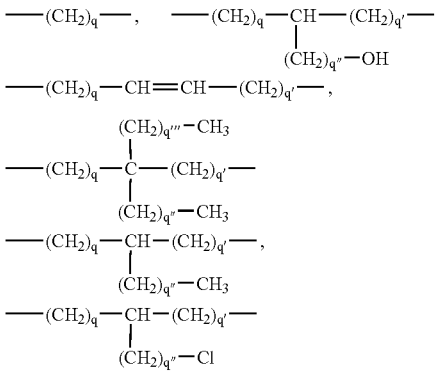

wherein each of q, q', q" and q'" is an integer, wherein the total number of carbon atoms in each group falls in the above-mentioned range (not less than 2) for the group R1.

Among these groups, groups having formula $—(CH_2)_q—$ are preferable.

Suitable groups for use as the group R2 include the following:

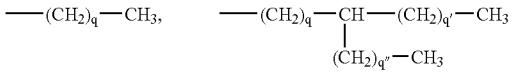

-continued

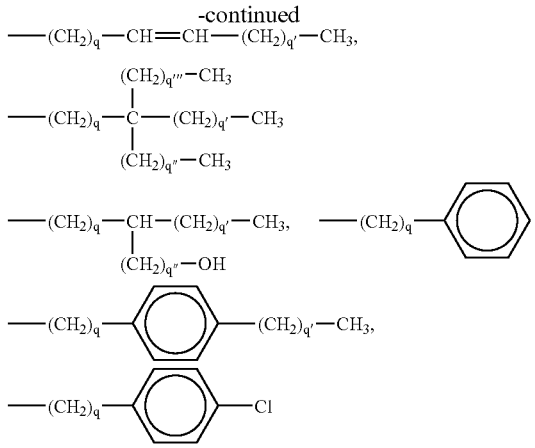

wherein each of q, q', q" and q'" is an integer, wherein the total number of carbon atoms in each group falls in the above-mentioned range (from 1 to 22) for the group R2.

Among these groups, groups having formula $—(CH_2)_q—CH_3$ are preferable.

Suitable groups for use as the group X include divalent groups having at least one of the following groups:

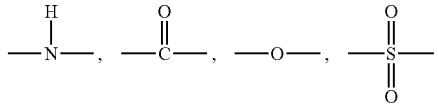

Specific examples of the groups for use as the group X include the following:

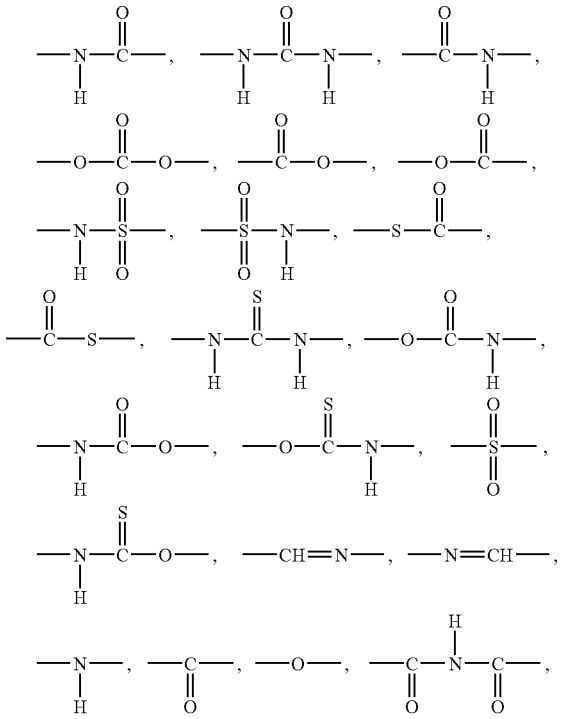

-continued

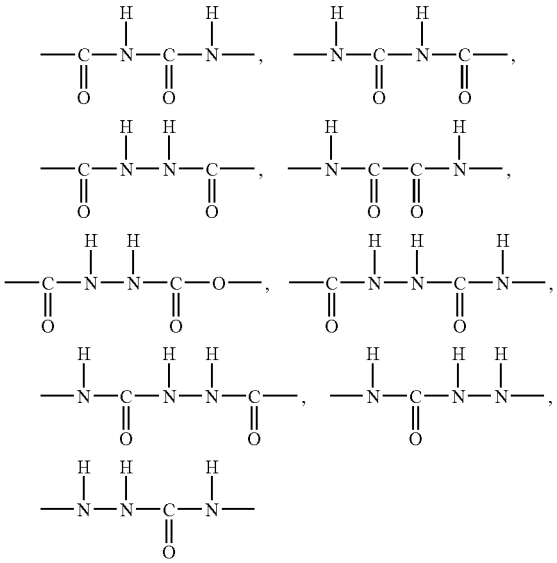

Among these groups, the following groups are preferable.

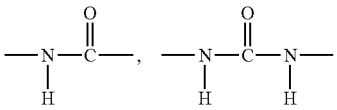

Suitable compounds for use as the phenolic compounds having formula (1) include compounds having one of the following formulae (5) and (6).

(5)

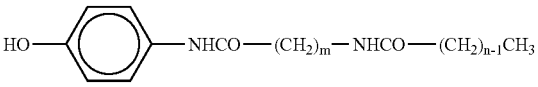

(6)

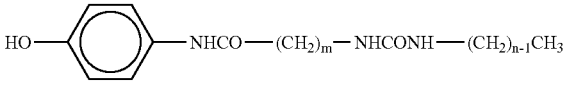

wherein m is an integer of from 5 to 11 and n is an integer of from 8 to 22.

Specific examples of the compounds having formula (5) or (6) include the following.

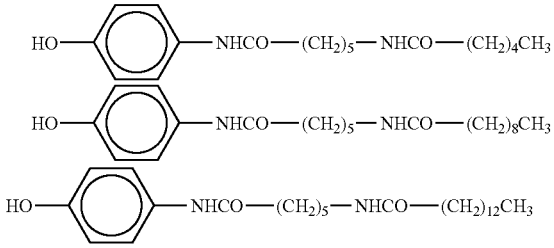

-continued

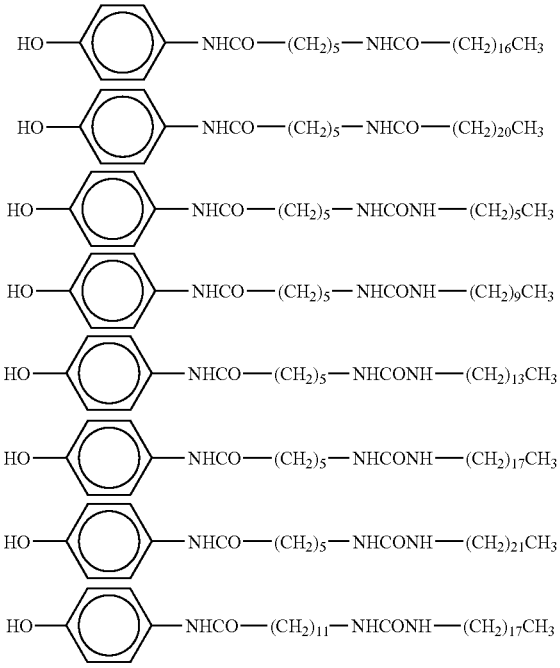

<Electron Donating Coloring Agent>

Known electron donating coloring compounds can be used as the electron donating coloring agent, and for example, leuco dyes can be preferably used therefor.

Suitable leuco dyes for use as the electron donating coloring agent include fluoran compounds and azaphthalide compounds.

Specific examples of the leuco dyes include the following:

2-anilino-3-methyl-6-diethylaminofluoran,
2-anilino-3-methyl-6-di(n-butylamino)fluoran,
2-anilino-3-methyl-6-(N-n-propyl-N-methylamino)fluoran,
2-anilino-3-methyl-6-(N-isopropyl-N-methylamino)fluoran,
2-anilino-3-methyl-6-(N-isobutyl-N-methylamino)fluoran,
2-anilino-3-methyl-6-(N-n-amyl-N-methylamino)fluoran,
2-anilino-3-methyl-6-(N-sec-butyl-N-methylamino)fluoran,
2-anilino-3-methyl-6-(N-n-amyl-N-ethylamino)fluoran,
2-anilino-3-methyl-6-(N-isoamyl-N-ethylamino)fluoran,
2-anilino-3-methyl-6-(N-n-propyl-N-isopropylamino)fluoran,
2-anilino-3-methyl-6-(N-cyclohexyl-N-methylamino)fluoran,
2-anilino-3-methyl-6-(N-ethyl-p-toluidino)fluoran,
2-anilino-3-methyl-6-(N-methyl-p-toluidino)fluoran,
2-(m-trichloromethylanilino)-3-methyl-6-diethylaminofluoran,
2-(m-trifluoromethylanilino)-3-methyl-6-diethylaminofluoran,
2-(m-trichloromethylanilino)-3-methyl-6-(N-cyclohexyl-N-methylamino)fluoran,
2-(2,4-dimethylanilino)-3-methyl-6-diethylaminofluoran,
2-(N-ethyl-p-toluidino)-3-methyl-6-(N-ethylanilino)fluoran, 2-(N-ethyl-p-toluidino)-3-methyl-6-(N-propyl-p-toluidino)fluoran,
2-anilino-6-(N-n-hexyl-N-ethylamino)fluoran,
2-(o-chloroanilino)-6-diethylaminofluoran,
2-(o-chloroanilino)-6-dibutylaminofluoran,
2-(m-trifluoromethylanilino)-6-diethylaminofluoran,
2,3-dimethyl-6-dimethylaminofluoran,
3-methyl-6-(N-ethyl-p-toluidino)fluoran,
2-chloro-6-diethylaminofluoran,
2-bromo-6-diethylaminofluoran,
2-chloro-6-dipropylaminofluoran,
3-chloro-6-cyclohexylaminofluoran,
3-bromo-6-cyclohexylaminofluoran,
2-chloro-6-(N-ethyl-N-isoamylamino)fluoran,
2-chloro-3-methyl-6-diethylaminofluoran,
2-anilino-3-chloro-6-diethylaminofluoran,
2-(o-chloroanilino)-3-chloro-6-cyclohexylaminofluoran,
2-(m-trifluoromethylanilino)-3-chloro-6-diethylaminofluoran,
2-(2,3-dichloroanilino)-3-chloro-6-diethylaminofluoran,
1,2-benzo-6-diethylaminofluoran,
3-diethylamino-6-(m-trifluoromethylanilino)fluoran,
3-(1-ethyl-2-methylindole-3-yl)-3-(2-ethoxy-4-diethylaminophenyl)-4-azaphthalide,
3-(1-ethyl-2-methylindole-3-yl)-3-(2-ethoxy-4-diethylaminophenyl)-7-azaphthalide,
3-(1-octyl-2-methylindole-3-yl)-3-(2-ethoxy-4-diethylaminophenyl)-4-azaphthalide,
3-(1-ethyl-2-methylindole-3-yl)-3-(2-methyl-4-diethylaminophenyl)-4-azaphthalide,
3-(1-ethyl-2-methylindole-3-yl)-3-(2-methyl-4-diethylaminophenyl)-7-azaphthalide,
3-(1-ethyl-2-methylindole-3-yl)-3-(4-diethylaminophenyl)-4-azaphthalide,
3-(1-ethyl-2-methylindole-3-yl)-3-(4-N-n-amyl-N-methylaminophenyl)-4-azaphthalide,
3-(1-methyl-2-methylindole-3-yl)-3-(2-hexyloxy-4-diethylaminophenyl)-4-azaphthalide,
3,3-bis(2-ethoxy-4-diethylaminophenyl)-4-azaphthalide,
3,3-bis(2-ethoxy-4-diethylaminophenyl)-7-azaphthalide, etc.

In addition, the following leuco dyes can also be used.

2-(p-acetylanilino)-6-(N-n-amyl-N-n-butylamino)fluoran,
2-benzylamino-6-(N-ethyl-p-toluidino)fluoran,
2-benzylamino-6-(N-methyl-2,4-dimethylanilino)fluoran,
2-benzylamino-6-(N-ethyl-2,4-dimethylanilino)fluoran,
2-benzylamino-6-(N-methyl-p-toluidino)fluoran,
2-benzylamino-6-(N-ethyl-p-toluidino)fluoran,
2-(di-p-methylbenzylamino)-6-(N-ethyl-p-toluidino)fluoran,
2-(α-phenylethylamino)-6-(N-ethyl-p-toluidino) fluoran,
2-methylamino-6-(N-methylanilino)fluoran,
2-methylamino-6-(N-ethylanilino)fluoran,
2-methylamino-6-(N-propylanilino)fluoran,
2-ethylamino-6-(N-methyl-p-toluidino)fluoran,
2-methylamino-6-(N-methyl-2,4-dimethylanilino)fluoran,
2-ethylamino-6-(N-ethyl-2,4-dimethylanilino)fluoran,
2-dimethylamino-6-(N-methylanilino)fluoran,
2-dimethylamino-6-(N-ethylanilino)fluoran,
2-diethylamino-6-(N-methyl-p-toluidino)fluoran,
2-diethylamino-6-(N-ethyl-p-toluidino)fluoran,
2-dipropylamino-6-(N-methylanilino)fluoran,
2-dipropylamino-6-(N-ethylanilino)fluoran,
2-amino-6-(N-methylanilino)fluoran,
2-amino-6-(N-ethylanilino)fluoran,
2-amino-6-(N-propylanilino)fluoran,
2-amino-6-(N-methyl-p-toluidino)fluoran,
2-amino-6-(N-ethyl-p-toluidino)fluoran,
2-amino-6-(N-propyl-p-toluidino)fluoran,
2-amino-6-(N-methyl-p-ethylanilino)fluoran,
2-amino-6-(N-ethyl-p-ethylanilino)fluoran,
2-amino-6-(N-propyl-p-ethylanilino)fluoran,
2-amino-6-(N-methyl-2,4-dimethylanilino)fluoran,
2-amino-6-(N-ethyl-2,4-dimethylanilino)fluoran,
2-amino-6-(N-propyl-2,4-dimethylanilino)fluoran,
2-amino-6-(N-methyl-p-chloroanilino)fluoran,
2-amino-6-(N-ethyl-p-chloroanilino)fluoran,
2-amino-6-(N-propyl-p-chloroanilino)fluoran,
1,2-benzo-6-(N-ethyl-N-isoamylamino)fluoran,
1,2-benzo-6-dibuylaminofluoran,
1,2-benzo-6-(N-methyl-N-cyclohexylamino)fluoran,
1,2-benzo-6-(N-ethyl-N-toluidino)fluoran, etc.

These compounds can be used alone or in combination. By forming multiple recording layers which includes different coloring agents achieving different colored states, recording media capable of displaying multi-color or full color images can be prepared.

The weight ratio (CD/CA) of the color developer (CD) (i.e., the electron accepting agent) to the coloring agent (CA) (i.e., the electron donating agent) is determined depending on the compounds used therefor, but is typically from 0.1 to 20, and preferably from 0.2 to 10. When the ratio is too small or too large, the color density of the displayed images decreases.

The recording layer preferably includes a discoloring accelerating agent having at least one of amide groups, urethane groups and urea groups. By using such a discoloring accelerating agent in combination with the color developers mentioned above, the resultant recording medium has good erasability even when erasing is performed at a high speed. The reason therefor is considered to be that an inter-molecular interaction is induced between the color developer and the discoloring accelerating agent during the erasing process.

Suitable compounds for use as the discoloring accelerating agent include compounds having one of the following formulae (7) to (13).

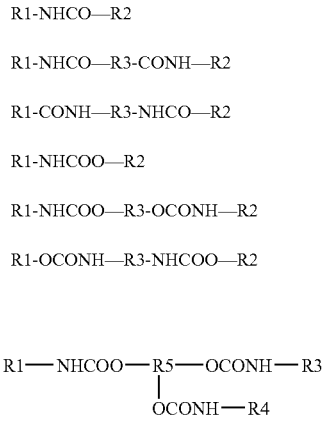

R1-NHCO—R2 (7)

R1-NHCO—R3-CONH—R2 (8)

R1-CONH—R3-NHCO—R2 (9)

R1-NHCOO—R2 (10)

R1-NHCOO—R3-OCONH—R2 (11)

R1-OCONH—R3-NHCOO—R2 (12)

R1—NHCOO—R5(—OCONH—R4)—OCONH—R3 (13)

In formulae (7) to (13), R1, R2 and R4 independently represent a linear, branched or unsaturated alkyl group having from 7 to 22 carbon atoms; R3 represents a divalent group having from 1 to 10 carbon atoms; and R5 represents a trivalent group having from 4 to 10 carbon atoms.

Specific examples of the groups R1, R2 and R4 include a heptyl group, an octyl group, a nonyl group, a decyl group, an undecyl group, a dodecyl group, a stearyl group, a behenyl group an oleyl group, etc.

Specific examples of the group R3 include a methylene group, an ethylene group, a propylene group, a butylene group, a heptamethylene group, hexamethylene group, octamethylene group, a —$C_3H_6OC_3H_6$— group, a —$C_2H_4OC_2H_4$— group, a —$C_2H_4OC_2H_4OC_2H_4$— group, etc.

Specific examples of the group R5 include the following.

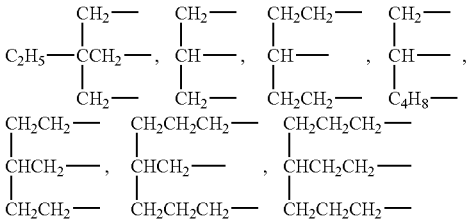

Specific examples of the compounds having one of formulae (7) to (13) include the following.

1) $C_{11}H_{23}CONHC_{12}H_{25}$
2) $C_{15}H_{31}CONHC_{16}H_{33}$
3) $C_{17}H_{35}CONHC_{18}H_{37}$
4) $C_{17}H_{35}CONHC_{18}H_{35}$
5) $C_{21}H_{41}CONHC_{18}H_{37}$
6) $C_{15}H_{31}CONHC_{18}H_{37}$
7) $C_{17}H_{35}CONHCH_2NHCOC_{17}H_{35}$
8) $C_{11}H_{23}CONHCH_2NHCOC_{11}H_{23}$
9) $C_7H_{15}CONHC_2H_4NHCOC_{17}H_{35}$
10) $C_9H_{19}CONHC_2H_4NHCOC_9H_{19}$
11) $C_{11}H_{23}CONHC_2H_4NHCOC_{11}H_{23}$
12) $C_{17}H_{35}CONHC_2H_4NHCOC_{17}H_{35}$
13) $(CH_3)_2CHC_{14}H_{28}CONHC_2H_4NHCOC_{14}H_{28}(CH_3)_2$
14) $C_{21}H_{43}CONHC_2H_4NHCOC_{21}H_{43}$
15) $C_{17}H_{35}CONHC_6H_{12}NHCOC_{17}H_{35}$
16) $C_{21}H_{43}CONHC_6H_{12}NHCOC_{21}H_{43}$
17) $C_{17}H_{33}CONHCH_2NHCOC_{17}H_{33}$
18) $C_{17}H_{33}CONHC_2H_4NHCOC_{17}H_{33}$
19) $C_{21}H_{41}CONHC_2H_4NHCOC_{21}H_{41}$
20) $C_{17}H_{33}CONHC_6H_{12}NHCOC_{17}H_{33}$
21) $C_8H_{17}NHCOC_2H_4CONHC_{18}H_{37}$
22) $C_{10}H_{21}NHCOC_2H_4CONHC_{10}H_{21}$
23) $C_{12}H_{25}NHCOC_2H_4CONHC_{12}H_{25}$
24) $C_{18}H_{37}NHCOC_2H_4CONHC_{18}H_{37}$
25) $C_{21}H_{43}NHCOC_2H_4CONHC_{21}H_{43}$
26) $C_{18}H_{37}NHCOC_6H_{12}CONHC_{18}H_{37}$
27) $C_{18}H_{35}NHCOC_4HBCONHC_{18}H_{35}$
28) $C_{18}H_{35}NHCOC_8H_{16}CONHC_{18}H_{35}$
29) $C_{12}H_{25}OCONHC_{18}H_{37}$
30) $C_{13}H_{27}OCONHC_{18}H_{37}$
31) $C_{16}H_{33}OCONHC_{18}H_{37}$
32) $C_{18}H_{37}OCONHC_{18}H_{37}$
33) $C_{21}H_{43}OCONHC_{18}H_{37}$
34) $C_{12}H_{25}OCONHC_{16}H_{33}$
35) $C_{13}H_{27}OCONHC_{16}H_{33}$
36) $C_{16}H_{33}OCONHC_{16}H_{33}$
37) $C_{18}H_{37}OCONHC_{16}H_{33}$
38) $C_{21}H_{43}OCONHC_{16}H_{33}$
39) $C_{12}H_{25}OCONHC_{14}H_{29}$
40) $C_{13}H_{27}OCONHC_{14}H_{29}$
41) $C_{16}H_{33}OCONHC_{14}H_{29}$
42) $C_{18}H_{37}OCONHC_{14}H_{29}$
43) $C_{22}H_{45}OCONHC_{14}H_{29}$
44) $C_{12}H_{25}OCONHC_{12}H_{25}$
45) $C_{13}H_{27}OCONHC_{12}H_{25}$
46) $C_{16}H_{33}OCONHC_{12}H_{25}$
47) $C_{18}H_{37}OCONHC_{12}H_{25}$
48) $C_{21}H_{43}OCONHC_{12}H_{25}$
49) $C_{22}H_{45}OCONHC_{18}H_{37}$
50) $C_{18}H_{37}NHCOOC_2H_4OCONHC_{18}H_{37}$
51) $C_{18}H_{37}NHCOOC_3H_6OCONHC_{18}H_{37}$
52) $C_{18}H_{37}NHCOOC_4H_8OCONHC_{18}H_{37}$
53) $C_{18}H_{37}NHCOOC_6H_{12}OCONHC_{18}H_{37}$
54) $C_{18}H_{37}NHCOOC_8H_{16}OCONHC_{18}H_{37}$
55) $C_{18}H_{37}NHCOOC_2H_4OC_2H_4OCONHC_{18}H_{37}$
56) $C_{18}H_{37}NHCOOC_3H_6OC_3H_6OCONHC_{18}H_{37}$
57) $C_{18}H_{37}NHCOOC_{12}H_{24}OCONHC_{18}H_{37}$
58) $C_{18}H_{37}NHCOOC_2H_4OC_2H_4OC_2H_4OCONHC_{18}H_{37}$
59) $C_{16}H_{33}NHCOOC_2H_4OCONHC_{16}H_{33}$
60) $C_{16}H_{33}NHCOOC_3H_6OCONHC_{16}H_{33}$
61) $C_{16}H_{33}NHCOOC_4H_8OCONHC_{16}H_{33}$
62) $C_{16}H_{33}NHCOOC_6H_{12}OCONHC_{16}H_{33}$
63) $C_{16}H_{33}NHCOOC_8H_{16}OCONHC_{16}H_{33}$
64) $C_{18}H_{37}OCONHC_6H_{12}NHCOOC_{18}H_{37}$
65) $C_{16}H_{33}OCONHC_6H_{12}NHCOOC_{16}H_{33}$
66) $C_{14}H_{29}OCONHC_6H_{12}NHCOOC_{14}H_{29}$
67) $C_{12}H_{25}OCONHC_6H_{12}NHCOOC_{12}H_{25}$
68) $C_{10}H_{21}OCONHC_6H_{12}NHCOOC_{10}H_{21}$
69) $C_8H_{17}OCONHC_6H_{12}NHCOOC_8H_{17}$

70)

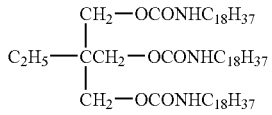

71)

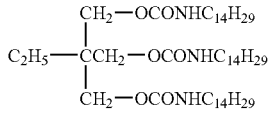

72)

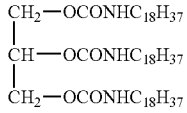

73)

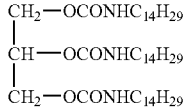

74)

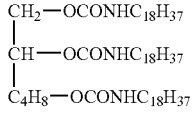

75)

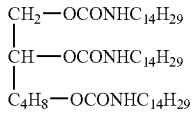

76)

-continued

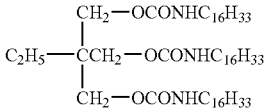

77)

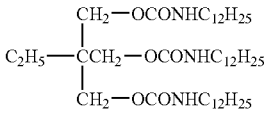

78)

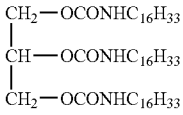

79)

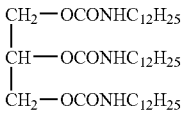

80)

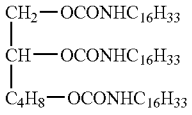

81)

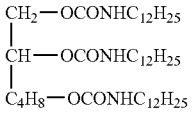

The added amount of the discoloring accelerating agent in the recording layer is from 0.1 to 300 parts by weight, and preferably from 3 to 100 parts by weight, per 100 parts by weight of the color developer included in the recording layer. Each of the coloring agents and the color developers can be included in the recording layer while being microencapsulated. The weight ratio (R/CA) of resin components (R) to the coloring agent (CA) in the recording layer is preferably from 0.1 to 10. When the ratio is too low, the recording layer has low heat resistance. In contrast, when the ratio is too high, the resultant images have low color density.

The recording layer can include other components such as binder resins, fillers, lubricants and surfactants. Further, the recording layer can include additives such as electroconductive agents, antioxidants, photostabilizers, coloring stabilizers, etc.

<Binder Resin>

Specific examples of the resins for use as the binder resin in the recording layer include polyvinyl chloride, polyvinyl acetate, vinyl chloride—vinyl acetate copolymers, ethyl cellulose, polystyrene, styrene copolymers, phenoxy resins, polyester resins, aromatic polyester resins, polyurethane, polycarbonate, polyacrylate, polymethacrylate, acrylic copolymers, maleic acid copolymers, polyvinyl alcohol, modified polyvinyl alcohol, hydroxyethyl cellulose, carboxylmethyl cellulose, starchs, etc.

The main purpose of adding a binder resin in the recording layer is to uniformly disperse the above-mentioned materials in the recording layer. Therefore, it is preferable to use a resin having high heat resistance as the binder resin. For example, the resin can be preferably crosslinked using heat, ultraviolet rays and/or electron beams.

Specific examples of the crosslinkable resins include known crosslinkable resins such as resins having a functional group capable of reacting with a crosslinking agent, such as acrylic polyol resins, polyester polyol resins, polyurethane polyol resins, phenoxy resins, polyvinyl butyral resins, cellulose acetate propionate resins, and cellulose acetate butyrate resins; and copolymers of a monomer having a functional group capable of reacting with a crosslinking agent with other monomers; etc.

Suitable crosslinking agents for use in crosslinking the crosslinkable binder resin include isocyanate compounds, amine compounds, phenolic compounds, epoxy compounds, etc. Among these compounds, isocyanate compounds are preferably used. Suitable isocyanate compounds include modified isocyanate compounds such as urethane modified isocyanate compounds, allophanate modified isocyanate compounds, isocyanaurate compounds, burette type isocyanate compounds, carbodiimide modified isocyanate compounds, and blocked isocyanate compounds. Specific examples of the isocyanate compounds to be modified include tolylene diisocyanate (TDI), 4,4-diphenylmethane idisocyanate (MDI), xylylene diisocyanate (XDI), naphthylene diisocyante (NDI), p-pheylene diisocyanate (PPDI), tetramethylxylylene diisocyanate (TMXDI), mexamethylene diisocyanate (HDI), dicyclohexyl-methan diisocyanate (HMDI), isophorone diisocyanate (IPDI), lysin diisocyanate (LDI), isopropylidenebis (4-cyclohexylisocyanate) (IPC), cyclohexyl diisocyanate (CHDI), tolidine diisocyanate (TODI), etc., but are not limited thereto.

When the binder resins are crosslinked, catalysts which can be used for the crosslinking reactions of this type can be used as a crosslinking accelerating agent. Specific examples of the crosslinking accelerating agent include tertiary amines such as 1,4-diaza-bicyclo(2,2,2) octane, and metal compounds such as organic tin compounds.

All of the added crosslinking agent is not necessarily reacted with the binder resins, i.e., the recording layer may include non-reacted crosslinking agent. Since the crosslinking reaction gradually proceeds, presence of non-reacted crosslinking agent does not necessarily mean that the binder resin is not crosslinked at all. Whether or not the binder resin is crosslinked can be determined by dipping the recording layer in a solvent capable of dissolving the binder resin if the resin is not crosslinked. Specifically, if the binder resin is not crosslinked, the entire recording layer is dissolved in such a solvent, and there is no solid components in the mixture. More specifically, whether or not the binder resin is crosslinked can be determined by checking the gel fraction of the recording layer. The gel fraction can be determined as follows.

When a crosslinked resin is mixed with a solvent, the resin is present in the solvent while losing its mobility, resulting in formation of a gel. The gel fraction is defined as the weight ratio of the gel to the total weight of the resin. The gel fraction is preferably not less than 30%, more preferably not less than 50%, even more preferably not less than 70% and still more preferably not less than 80%. When the gel fraction is too low, the resultant recording layer has poor durability. In order to increase the gel fraction, it is preferably to add a resin which can be crosslinked by heat, ultraviolet rays, and/or electron beams, or crosslink the binder resin itself.

The method for determining the gel fraction is as follows.

(1) the recording layer, which is peeled from a substrate, is weighed to determine the initial weight (W0) thereof;

(2) the recording layer, which is sandwiched with a 400-mesh screen which is previously weighed, is dipped into a solvent which can dissolve the resin included in the recording layer if the resin is not crosslinked;
(3) the screen having the recording layer therein is allowed to settle in the solvent for 24 hours;
(4) the screen is pulled out of the solvent, followed by drying in vacuum; and
(5) the dried screen is weighed to determine the weight (W1) of the residue of the recording layer.

The gel fraction is calculated by the following equation:

$$\text{Gel Fraction } (\%)=(W1/W0)\times 100$$

In this case, the calculation is performed while the materials (such as low molecular weight organic compounds) in the recording layer other than the resin components are excluded. When the weight of such low molecular weight compounds included in the recording layer is unknown, the ratio of the low molecular weight compounds to the resin in the recording layer is previously determined by observing the cross-section of the recording layer with a transmission electron microscope (TEM) or a scanning electron microscope (SEM). The weight ratio (LMC/R) of the low molecular weight compounds (LMC) to the resin (R) in the recording layer can be determined by the following equation:

$$\text{Weight ratio } (LMC/R)=(A_{LMC}\times\rho_{LMC}/A_R\times\rho_R)$$

wherein $A_{LMC}$ and $A_R$ represent the areas of the low molecular weight compounds and the resin, respectively, in the cross-section, and $\rho_{LMC}$ and $\rho_R$ represent the specific gravities of the low molecular weight compounds and the resin, respectively.

When other layers are formed on or under the recording layer, the cross-section of the recording medium is observed with a TEM or SEM to determine the thicknesses of the layers. Then the layers other than the recording layer are removed by scraping off. The thus prepared recording layer is subjected to the gel fraction determining test. If a crosslinked protective layer is present on the surface of the recording layer, it is preferable to scrape off the protective layer-to an extent such that the upper portion of the recording layer is also be removed as well as the protective layer, to prevent the gel fraction of the recording layer being influenced by the crosslinked protective layer.

Filler

As mentioned above, the recording layer can include a filler. Specific examples of the filler for use in the recording layer included inorganic fillers such as calcium carbonate, magnesium carbonate, silicic acid anhydride, alumina, iron oxide, calcium oxide, magnesium oxide, chromium oxide, manganese oxide, silica, talc and mica; and organic fillers such as silicone resins, cellulose resins, epoxy resins, nylon resins, phenolic resins, polyurethane resins, urea resins, melamine resins, polyester resins, polycarbonate resins, polystyrene resins, styrene—isoprene copolymers, styrene—vinyl benzene copolymers, vinylidene chloride—acrylic copolymers, acrylic—urethane copolymers, ethylene—acrylic copolymers, polyethylene, benzoguanamine—formaldehyde resins, melamine—formaldehyde resins, polymethyl methacrylate, vinyl chloride resins, etc. The materials can be used alone or in combination. The shape of the filler is not particularly limited, and any shapes such as spherical form, plate form, needle form, and irregular form can be available.

The content of the filler in the recording layer is preferably from 0.5 to 50% by volume.

<Lubricant>

The recording layer can include a lubricant. Specific examples thereof include synthesized waxes such as ester waxes, paraffin waxes, and polyethylene waxes; vegetable waxes such as hardened castor oil; animal waxes such as hardened beef tallow oil; higher alcohols such as stearyl alcohol and behenyl alcohol; higher fatty acids such as margaric acid, lauric acid, myristic acid, palmitic acid, stearic acid, behenic acid and fromeric acid; fatty acid esters such as fatty acid esters of sorbitan; amides such as stearic acid amide, oleic acid amide, lauric acid amide, ethylenebisstearic acid amide, methylenbisstearic acid amide and methylolstearic acid amide; etc.

The content of the lubricant in the recording layer is preferably from 0.1 to 95% by volume, and more preferably from 1 to 75% by volume.

<Surfactant>

The recording layer can include a surfactant. Known surfactants such as anionic surfactants, cationic surfactants, nonoinic surfactants, and ampholytic surfactants can be used for the recording layer.

<Plasticizer>

The recording layer can include a plasticizer. Known plasticizers can be used for the recording layer. Specific examples thereof include phosphoric acid esters, fatty acid esters, phthalic acid esters, dibasic acid esters, glycols, polyester-based plasticizers, epoxy-based plasticizers, etc.

The method for preparing the recording layer is not particularly limited. For example, the following methods can be used.

(1) a coating liquid in which recording layer constituents such as a binder resin, an electron donating coloring compound, and an electron accepting color developer are dissolved or dispersed in a solvent is coated on a substrate, followed by drying and crosslinking;
(2) a coating liquid which is prepared by dispersing an electron donating coloring agent and an electron accepting color developer in a previously prepared resin solution is coated on a substrate, followed by drying and crosslinking; and
(3) a sheet of recording layer is formed by heating the constituents so as to be melted, followed by molding, and then the sheet is crosslinked.

The electron accepting color developer is present in a form of particles in the recording layer.

The solvents for use in the methods (1) and (2) are not particularly limited, and a proper solvent is determined depending on the resin, coloring agent and color developer used. Specific examples of the solvents include tetrahydrofuran, methyl ethyl ketone, methyl isobutyl ketone, chloroform, carbon tetrachloride, ethanol, toluene, benzene, etc.

The recording layer coating liquid can include additives such as pigments, antifoaming agents, dispersants, slipping agents, antiseptic agents, crosslinking agents, plasticizers, etc.

The coating method is not particularly limited, and a proper coating method is used. For example, coating methods such as blade coating, wire bar coating, spray coating, air knife coating, bead coating, curtain coating, gravure coating, kiss coating, reverse roll coating, dip coating and die coating can be used. The form of the substrate to be subjected to the coating treatment is not particularly limited, and sheet-form or roll-form substrates can be used.

The drying conditions are not particularly limited, and a proper drying condition is determined depending on the materials used and the purpose of the recording medium. For example, the drying temperature is typically from room temperature to 140° C., and the drying time is typically from 10 minutes to 1 hour.

The recording layer can be crosslinked, for example, by being heated, or exposed to ultraviolet light or electron beams. Namely, by heating, or irradiating a mixture of a resin (such as acrylic resins) and a polyisocyanate with ultraviolet light or electron beams, the recording layer can be crosslinked.

Irradiation of ultraviolet light can be performed using any known ultraviolet irradiating devices. The devices typically include a light source, an irradiation device, a power source, a cooling device and a feeding device.

Specific examples of the light source include mercury lamps, metal halide lamps, potassium lamps, mercury xenon lamps, flash lamps, etc. A proper light source is selected so that the photopolymerization initiator and photopolymerization accelerator can absorb the ultraviolet light emitted thereby. In addition, proper irradiation conditions (such as lamp power and feeding speed) are determined so that the resultant recording layer has a desired gel fraction.

Irradiation of electron beams can be performed using any known electron beam irradiators such as scanning beam type irradiators and area beam type irradiators. A proper irradiator is selected depending on the irradiation area and irradiation dose needed. In addition, proper irradiation conditions (such as electron flow, irradiation width, and feeding speed) are determined so that the resultant recording layer has a desired gel fraction. Specifically, the irradiation dose is calculated by the following equation.

$$D=(\Delta E/\Delta R)\times\eta\times I/(W\times V)$$

wherein D represents the irradiation dose needed (Mrad); $\Delta E/\Delta R$ represents the average energy loss; $\eta$ represents the efficiency; and W and V represent the irradiation width (cm) and feeding speed (cm/s).

For the industrial purpose, the following simplified version of the equation is used.

$$D\times V=K\times I/W$$

The rated dose of an irradiation device is represented in a unit of Mrad·m/min and the rated electron flow is from 20 to 500 mA.

The thickness of the recording layer is not particularly limited, but is typically from 1 to 20 μm, and preferably from 3 to 15 μm. When the recording layer is too thin, the color density of the resultant images decreases, resulting in decrease in contrast of the images. In contrast, when the recording layer is too thick, the temperature of the heated recording layer varies particularly in the thickness direction thereof, and thereby the resultant images have uneven color density.

The recording medium of the present invention optionally includes one or more layers other than the recording layer, such as intermediate layer, protective layer, back layer, undercoat layer, light-heat conversion layer, coloring layer, air layer, light reflection layer, adhesive layer, etc. These layers may have a single-layered structure or a multi-layer structure.

<Intermediate Layer>

When a protective layer is formed on the recording layer, an intermediate layer can be formed therebetween to protect the recording layer from the solvents and monomers included in the protective layer coating liquid. One example of the intermediate layer is disclosed in JP-A 01-133781.

Suitable materials for use in the intermediate transfer layer include the resins mentioned above for use as the binder resin in the recording layer, and other thermoplastic and thermosetting resins. Specific examples thereof include polyethylene, polypropylene, polystyrene, polyvinyl alcohol, polyvinyl butyral, polyurethane, saturated polyester, unsaturated polyester, epoxy resins, phenolic resins, polycarbonate, polyamide, etc.

The intermediate layer preferably includes an ultraviolet absorbing agent such as inorganic ultraviolet absorbing agents and organic ultraviolet absorbing agents. Suitable organic ultraviolet absorbing agents include benzotriazole compounds, benzophenone compounds, salicylic acid ester compounds, cyano acrylate compounds, cinnamic acid compounds, etc. Among these compounds, benzotriazole type ultraviolet absorbing agents are preferably used. Specific examples of the benzotriazole type ultraviolet absorbing agents include 2-(2'-hydroxy-3',5'-di-t-butylphenyl)benzotriazole, 2-(2'-hydroxy-3'-t-butyl-5'-methylphenyl)benzotriazole, 2-(2'-hydroxy-3',5'-di-t-butylphenyl)-5-chlorobenzotriazole, 2-(2'-hydroxy-3'-t-butyl-5'-methylphenyl)-5-chlorobenzotriazole, etc. In addition, resins such as acrylic resins and styrene resins, which have, as a pendant, such an ultraviolet absorbing group that the above-mentioned compounds have, can also be used as the ultraviolet absorbing agent. The content of the ultraviolet absorbing agent in the intermediate layer is preferably from 0.5 to 10% by weight based on the total weight of the resin components included therein.

Suitable inorganic ultraviolet absorbing agents include metal compounds having an average particle diameter not greater than 100 nm. Specific examples thereof include metal oxide such as zinc oxide, indiumoxide, alumina, zirconiumoxide, tin oxide, cerium oxide, iron oxide, antimony oxide, barium oxide, calcium oxide, bismuth oxide, nickel oxide, magnesium oxide, chromium oxide, manganese oxide, tantalum oxide, niobium oxide, thorium oxide, hafnium oxide, molybdenum oxide, iron ferrite, nickel ferrite, cobalt ferrite, barium titanate, potassium titanate and complexes thereof; metal sulfides or sulfates such as zinc sulfide and barium sulfate; metal carbides such as titanium carbide, silicon carbide, molybdenum carbide, tungsten carbide and tantalum carbide; metal nitrides such as aluminum nitride, silicon nitride, boron nitride, zirconium nitride, vanadium nitride, titanium nitride, niobium nitride, and gallium nitride; etc. Among these materials, particulate metal oxides are preferably used. More preferably, silica, alumina, zinc oxide, and cerium oxide are preferably used.

The surface of the inorganic ultraviolet absorbing agents can be treated with a material such as silicone, waxes, organic silane compounds and silica.

The content of the inorganic ultraviolet absorbing agents in the intermediate layer is preferably from 1 to 95% by volume based on the total volume of the intermediate layer.

The above-mentioned ultraviolet absorbing agents can be included in the recording layer.

The thickness of the intermediate layer is preferably from 0.1 to 20 μm, and more preferably from 0.5 to 5 μm. The intermediate layer is typically prepared by the method mentioned above for use in preparing the recording layer. The solvents used for the coating liquid, dispersing machines for preparing the coating liquid, methods for coating the coating liquid, and methods for drying and crosslinking the coated layer, which are mentioned above for use in preparing the recording layer, can also be used for forming the intermediate layer.

<Protective Layer>

The recording medium of the present invention can include a protective layer overlying the recording layer. The protective layer preferably includes a crosslinked resin. Suitable resins for use as the crosslinked resin include the thermosetting resins, ultraviolet crosslinking resins, and electron beam crosslinking resins which are mentioned above for use in the recording layer. As mentioned above, an intermediate layer can be formed between the recording layer and the protective layer, to improve the adhesion of the protective layer to the recording layer; to prevent deterioration of the recording layer caused by coating a protective layer coating liquid; to prevent migration of the materials in the protective layer into the recording layer; and/or to prevent migration of the materials in the recording layer into the protective layer; etc.

The thickness of the protective layer is preferably from 0.1 to 20 μm, and more preferably from 0.3 to 10 μm. The protective layer is typically prepared by the method mentioned above for use in preparing the recording layer. The solvents used for the coating liquid, dispersing machines for preparing the coating liquid, methods for coating the coating liquid, and methods for drying and crosslinking the coated layer, which are mentioned above for use in preparing the recording layer, can also be used for forming the protective layer.

<Back Layer>

The recording medium of the present invention can include a back layer on a side of the substrate opposite that bearing the recording layer to enhance the feeding property thereof. The back layer may have a single-layered structure of a multi-layered structure. The back layer is preferably an outermost layer.

The back layer typically includes a binder resin, a filler, a lubricant, a colorant, etc.

Specific examples of the filler include inorganic fillers such as carbonates, metal oxides and sulfates; and organic fillers such as silicone resins, cellulose resins, epoxy resins, nylon resins, phenolic resins, polyurethane resins, urea resins, melamine resins, polyester resins, polycarbonate resins, polystyrene resins, acrylic resins, polyethylene resins, formaldehyde resins, polymethyl methacrylate, etc.

The thickness of the back layer is preferably from 0.1 to 20 μm, and more preferably from 0.3 to 10 μm.

<Undercoat Layer>

The recording medium can include a heat-insulating undercoat layer between the substrate and the recording layer to effectively utilize the heat applied to the recording layer when forming or erasing an image. Such an undercoat layer can be formed by coating a coating liquid including organic or inorganic fine hollow particles and a binder resin. An undercoat layer can also be formed to improve adhesion of the recording layer to the substrate and/or to prevent the materials in the recording layer from migrating to the substrate.

Suitable resins for use in the undercoat layer include the resins mentioned above for use in the recording layer. In addition, a filler such as inorganic fillers, e.g., calcium carbonate, magnesium carbonate, titanium oxide, silica, aluminum hydroxide, kaolin, talc, etc., and organic fillers can be included therein. In addition, additives such as lubricants, surfactants and dispersants can also be used therein.

<Colored Layer>

The recording medium of the present invention preferably includes a colored layer between the substrate and the recording layer to enhance the visibility of displayed images. The colored layer can be prepared by a method in which a coating liquid including a colorant-and a binder resin is coated on the substrate, followed by drying; a method in which a colored sheet is adhered to the substrate; or the like method.

<Print Layer>

The recording medium can include a colored print layer to develop a beautiful design. The colored print layer is typically prepared by printing images using one or more color print inks each including a colorant (such as dyes and pigments) and a binder resin such as thermoplastic resins, thermosetting resins, ultraviolet crosslinking resins, and electron beam crosslinking resins. The thickness of the print layer is not particularly limited, and a proper thickness is determined depending on the desired color density of the resultant print image.

<Air Layer>

The recording layer can include an air layer between the substrate and the recording layer such that the recording layer does not directly contact with the substrate. The resin components, which are main components of the recording layer, typically have a refractive index of from 1.4 to 1.6 which is largely different from the refractive index (i.e., 1.0) of the air layer. Therefore, incident light tends to reflects at the interface between the recording layer and the air layer. Namely, when the recording layer achieves an opaque state, the opacity of the recording layer can be enhanced, resulting in enhancement of the visibility of the displayed image.

In addition, since the air layer can serve as a heat insulating layer, the thermosensitivity of the recording medium can be enhanced. Further, the air layer has good cushion property, and therefore the pressure applied by a thermal printhead serving as a recording and/or erasing head can be dispersed, resulting in prevention of deformation and abrasion of the recording medium due to the pressure, and thereby good durability can be imparted to the recording medium.

<Head-matching Layer>

The recording layer can include a head-matching layer as an outermost layer to prevent a problem (sticking problem) in that the surface of the recording layer adheres to the thermal printhead, resulting in formation of a defective image or no image. The head-matching layer typically includes a heat resistant resin and an inorganic pigment. Suitable materials for use as the heat resistant resin include the resins mentioned above for use in the protective layer. Suitable pigments for use in the head-matching layer include calcium carbonate, kaolin, silica, aluminumhydroxide, alumina, aluminumsilicate, magnesium hydroxide, magnesium carbonate, magnesium oxide, titanium oxide, zinc oxide, barium sulfate, talc, etc. These pigments can be used alone or in combination. The particle diameter of the pigments is preferably from 0.01 to 10.0 μm, and more preferably from 0.05 to 8.0 μm. The added amount of the pigment in the layer is preferably from 0.001 to 2 parts by weight, and more preferably from 0.005 to 1 part by weight, per 1 part by weight of the heat resistant resin included in the head-matching layer.

<Light-heat Conversion Layer>

The recording layer can include a light-heat conversion layer which absorbs laser light to convert the light to heat for forming an image.

When the protective layer, print layer, and head-matching layer are prepared by crosslinking a resin using heat, ultraviolet rays or electron beams, it is preferable to use the crosslinking agents, photopolymerization initiators and/or photopolymerization accelerators mentioned above for use in the back layer and the recording layer.

The recording medium of the present invention can be processed so as to have a desired form such as the form of a card, a sheet or a roll. The recording medium with a card form can be used for prepaid cards, reward cards and credit cards. The recording medium with a sheet form (which has a dimension larger than a card) can be typically used for general documents and instruction sheets for process controlling.

<Other Layers>

The recording medium can include an irreversible thermosensitive recording layer. In this case, the color tone of the colored irreversible thermosensitive recording layer may be the same as or different from that of the colored reversible thermosensitive recording layer.

In addition, the recording medium can include a print layer including images such as character images, pictorial images, photograph images and images detected by infrared light. The print layer may be located on the same side as or the side opposite that bearing the recording layer. The print layer may be located on a portion of a surface or the entire surface of the recording medium. The print layer can be formed by a method such as offset printing, gravure printing, inkjet printing, thermal transfer printing or other image forming methods. A portion or entire the print layer may be covered with an OP varnish layer.

In addition, each of the layers mentioned above can be colored using a colorant such as dyes and pigments.

Further, the recording medium can include a hologram for security. Furthermore, a registered design or the like such as portraits, company marks, and symbol marks may be formed using a relief technology or a sunk relief technology.

Then the image processing apparatus configured to record and/or erase an image in the recording medium mentioned above will be explained.

Image recording and erasing can be performed using known image processing apparatus which can record and/or erase an image in reversible thermosensitive recording media. However, it is preferable to use the below-mentioned image processing apparatus of the present invention.

The image processing apparatus of the present invention preferably has an image recording device and an image erasing device. An image processing apparatus including an image recording/erasing device which can perform both image recording and image erasing is more preferable because image erasing and image recording can be performed at a high speed. Thermal printheads can be preferably used as the image recording/erasing device. Specifically, by changing the energy applied to the thermal printhead, image recording and erasing can be performed at the same time. Alternatively, an image processing apparatus using a thermal printhead as an image recording device and another heating device such as contact heating devices (e.g., thermal printheads, ceramic heaters in which a heating element is printed on an alumina substrate by a screen printing method, hot stamps, heat rollers and heat blocks), or non-contact heating devices (e.g., hot air blowers and infrared irradiators) can also be used.

Then the reversible thermosensitive recording device of the present invention will be explained.

Then the reversible thermosensitive recording device (hereinafter sometimes referred to as the recording device) of the present invention will be explained.

The recording device includes at least the thermosensitive recording layer mentioned above and an information storage portion, which are formed on a substrate such as cards. In this recording device, a portion of the information stored in the storage portion can be displayed in the recording layer. Therefore, such a recording device has good convenience. When the information in the storage portion is rewritten, the image information in the recording medium is also rewritten. Thus, the recording device can be repeatedly used many times.

Known memories can be used for the information storage portion. Specific examples of the memories include magnetic recording layers, magnetic stripes, IC memories, optical memories, RF-ID (Radio Frequency Identification) tags, etc. When the recording device has a size larger than the card size, IC memories, and RF-ID tags are preferably used. The RF-ID tags include an IC chip and an antenna connected with the IC chip.

The magnetic recording layer is typically prepared by a coating method in which a layer including a mixture of a magnetic material such as iron oxide and barium ferrite and a resin such as urethane resins and nylon resins is formed by coating, or a method such as deposition and sputtering in which a layer of a magnetic material is formed without using a resin. The magnetic recording layer may be formed on the same side as or the side opposite that bearing the recording layer. When the magnetic recording layer is formed on the same side, the layer can be formed between the substrate and the recording layer or over the recording layer.

In addition, the reversible thermosensitive recording layer can be used as the storage portion while a barcode (including two-dimensional barcodes) is recorded therein.

Among these memories, magnetic memories and ICs can be preferably used.

Then specific examples of the reversible thermosensitive recording medium (label), reversible thermosensitive recording device, image processing apparatus and image processing method will be explained. In the description below, the surface of the reversible thermosensitive recording medium means the surface of the side of the recording medium on which the reversible thermosensitive recording layer is present. the surface is not limited to the surface of the protective layer and may be the surface of the print layer, OP layer, head-matching layer or another outermost layer.

As mentioned above, the recording device of the present invention include a recording layer and an information storage portion. One of the suitable materials for use in the information storage portion is RF-ID tags.

FIG. 1 is a schematic view illustrating a RF-ID tag. An RF-ID tag 85 has an IC chip 81 and an antenna 82 connected with the IC chip 81. The IC chip 81 has a storage section, a power source controller, a transmitter and a receiver, and performs transmission. A reader/writer communicates with the RF-ID tag to read the information stored in the RF-ID tag 85 or write new information in the RF-ID tag 85. Specifically, when the antenna 82 of the RF-ID tag 85 receives an electric wave from a reader/writer, the RF-ID tag generates a voltage by electromagnetic induction-caused by resonance. Therefore, the IC chip 81 is activated, and converts the stored information to signals. Then the IC chip 81 transmits the signals to the reader/writer. The antenna of the reader/writer receives the signals, and the data processor thereof recognizes and performs data processing using software.

Figure 2:
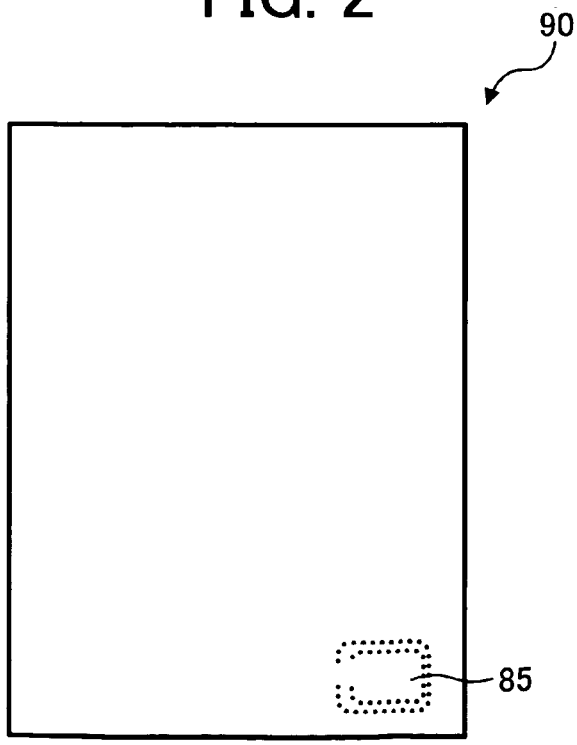
FIG. 2 is a schematic view illustrating an embodiment of the reversible thermosensitive recording device of the present invention having a RF-ID tag on the backside thereof.

The RF-ID tag 85 has a form of a label or a card, and can be adhered to a recording device 90 of the present invention, as illustrated in FIG. 2. In this case, the RF-ID tag 85 can be adhered to the recording layer side but is preferably adhered to the backside of the recording device. The RF-ID tag can be adhered to the recording device using an adhesive.

Figure 3A:
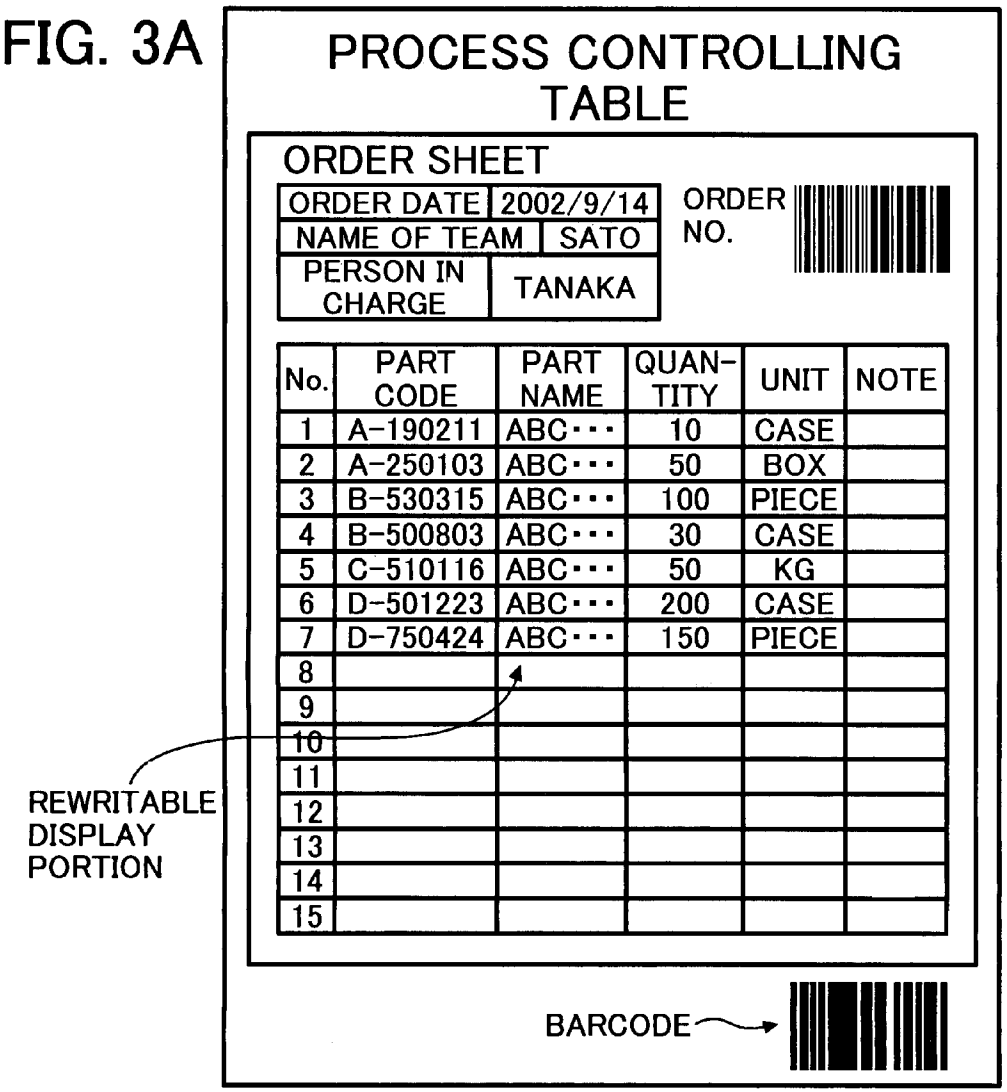
FIG. 3 is a schematic view illustrating an embodiment (an industrial use rewritable sheet) of the reversible thermosensitive recording medium of the present invention.
Figure 3B:
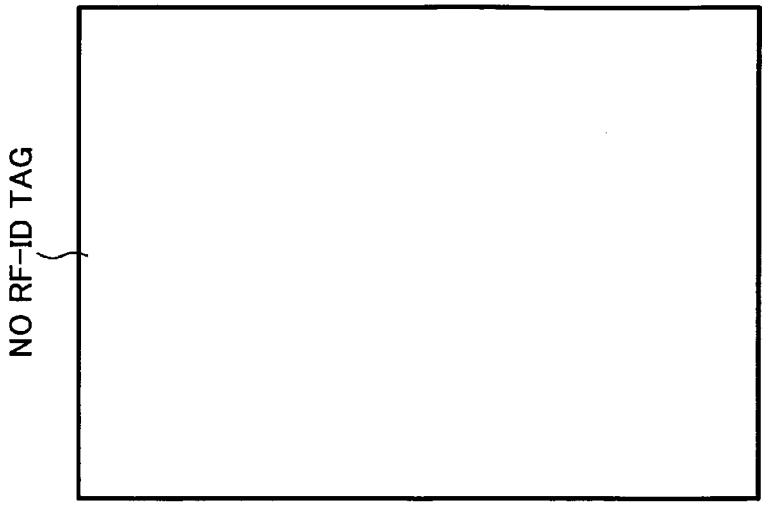

FIG. 3 illustrates an industrial rewritable sheet 90 (i.e., a reversible thermosensitive recording device) to which the recording medium of the present invention is applied. As illustrated in FIG. 3A, a rewritable display portion is provided on the front side of the recording device. In FIG. 3B, there is no RF-ID tag on the backside of the recording device, but as illustrated in FIG. 2, a RF-ID tag is preferably adhered thereto because the recording medium has good convenience.

Figure 4:
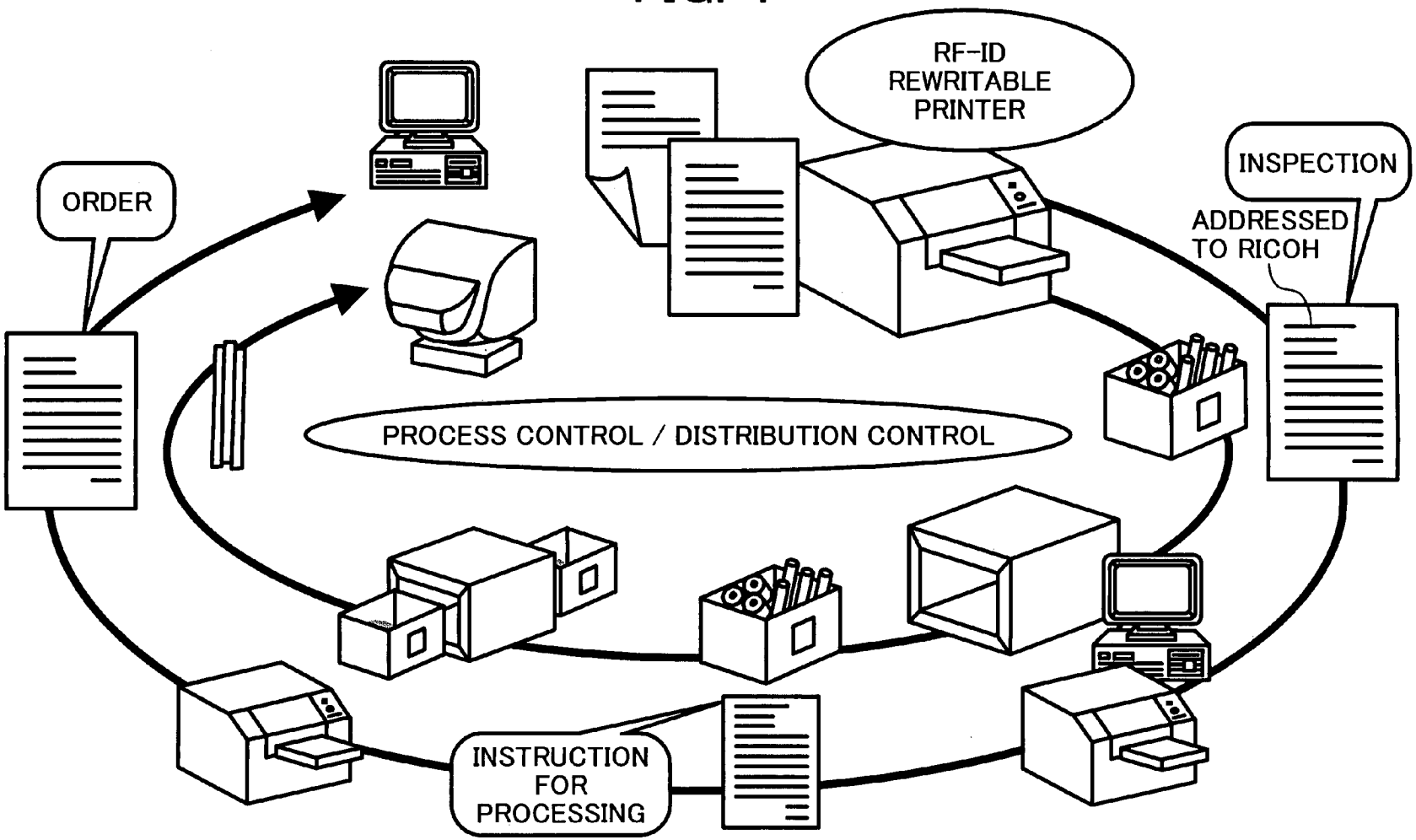
FIG. 4 is a schematic view illustrating how the reversible thermosensitive recording medium illustrated in FIG. 3 is used.

FIG. 4 is a schematic view illustrating how the rewritable sheet including the reversible thermosensitive recording medium and a RF-ID tag is used in a process control/distribution control system. At first, information on the raw materials, such as name of the materials and quantity thereof, is recorded in the rewritable sheet and the RF-ID tag. The sheet is attached to a returnable container to determine whether the raw materials are correctly contained therein. When an instruction for processing is issued to the thus delivered raw materials, processing information is recorded in a rewritable sheet and a RF-ID tag therein, which serves as an instruction sheet. Then the raw materials are processed. When an order instruction is issued to the thus processed raw materials, a rewritable sheet with a RF-ID tag in which the order information is recorded is attached to the returnable container including the good (i.e., the processed raw materials). After the good is shipped, the rewritable sheet is collected to read the shipment information, and the collected rewritable sheet can be used as a delivery slip.

<Reversible Thermosensitive Recording Label>

The reversible thermosensitive recording medium having a label form (hereinafter sometimes referred to as the recording label) has the recording medium and an adhesive layer which is formed on the backside of the recording medium. The recording label can have other layers mentioned above for use in the recording medium. The adhesive layer may have a release paper thereon (release paper type) or no release paper (non-release paper type).

The form, structure and dimension of the adhesive layer are not particularly limited. As for the form, form of a sheet, and a film can be available. With respect to the structure, a single-layered or multi-layered structure is available. With respect to the dimension, the adhesive layer may be larger or smaller than the recording layer.

Suitable materials for use as the adhesive layer include any known adhesives. Specific examples thereof include urea resins, melamine resins, phenolic resins, epoxy resins, vinyl acetate resins, vinyl acetate—acrylic copolymers, ethylene—vinyl acetate copolymers, acrylic resins, polyvinyl ether resins, vinyl chloride—vinyl acetate copolymers, polystyrene resins, polyester resins, polyurethane resins, polyamide resins, chlorinated polyolefin resins, polyvinyl butyral resins, acrylate resins, methacrylate resins, natural rubbers, cyanoacrylate resins, silicone resins, etc. These resins can be used alone or in combination. In addition, the adhesive may be a hot-melt type adhesive or a liquid-type adhesive.

The recording label having an adhesive layer has such an advantage as to be attached to a surface or the entire surface of a thick material such as polyvinyl chloride cards with a magnetic stripe without using a coating method. In this case, a part of information stored in the magnetic stripe can be displayed in the recording layer.

The recording label can be used as labels displaying the information stored in rewritable media such as flexible discs (FDs), MDs, and DVD-RAMs.

Figure 5:
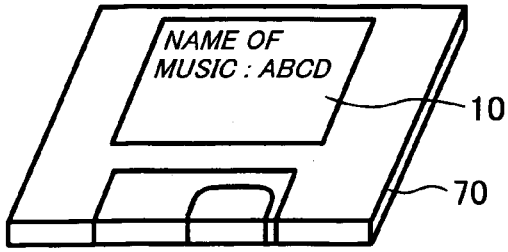
FIG. 5 is a schematic view illustrating a MD disk cartridge on which a label of the reversible thermosensitive recording medium of the present invention is attached.

As illustrated in FIG. 5, a recording label 10 of the present invention is adhered to a MD disc cartridge 70. In this case, it is possible to automatically rewrite the displayed information in the recording label when the information in the medium is changed.

Figure 6:
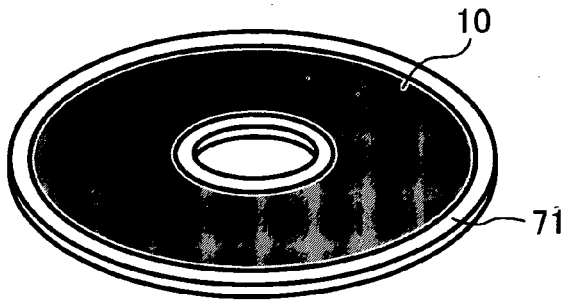
FIG. 6 is a schematic view illustrating a CD-RW on which a label of the reversible thermosensitive recording medium of the present invention is attached.

As illustrated in FIG. 6, the recording label 10 can be directly adhered to a CD-RW 71 itself, for which a disc cartridge is not used. When the recording label is used for a CD-R, a part of the information added to the CD-R can be displayed in the recording label.

Figure 7:
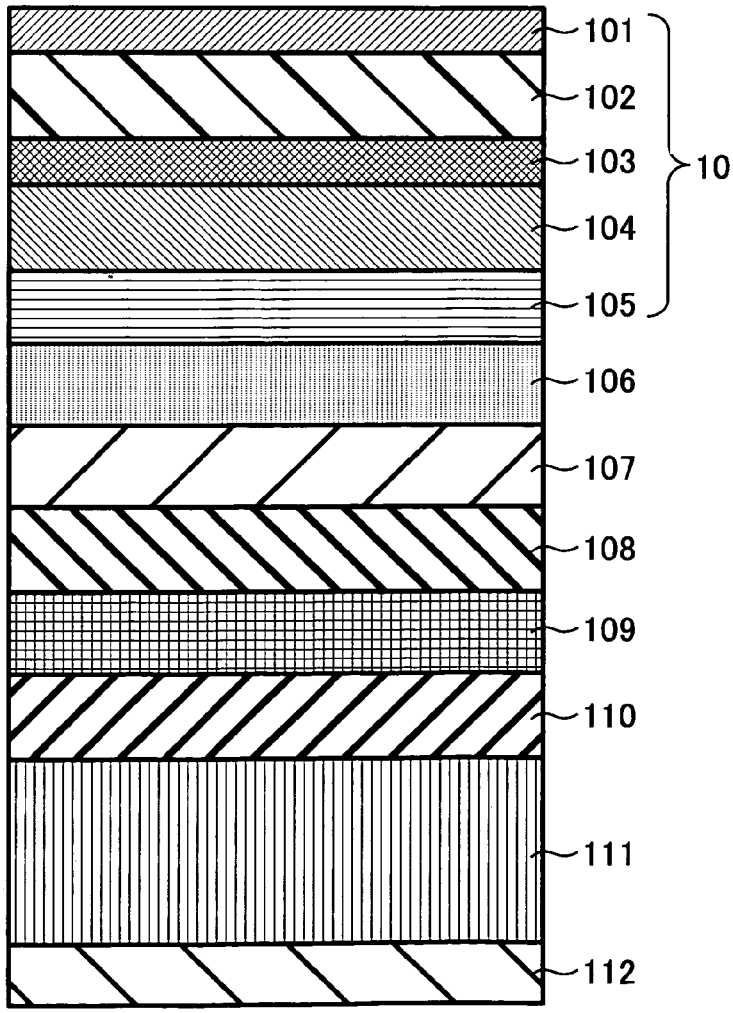
FIG. 7 is a schematic cross-sectional view of an optical information recording medium on which a label of the reversible thermosensitive recording medium of the present invention is attached.

FIG. 7 illustrates a cross-section of a phase change optical information recording medium (CD-RW) using a AgInSbTe type phase change material, on which the recording label 10 of the present invention is adhered. The CD-RW has a structure in which a first dielectric layer 110, an optical information storage layer 109, a second dielectric layer 108, a reflection layer 107, and an intermediate layer 106 are overlaid on a substrate 111. In addition, a hard coat layer 112 is formed on the opposite side of the substrate 111. The recording label 10 of the present invention is adhered to the intermediate layer 106, the recording label 10 of the present invention. The recording label 10 includes an adhesive layer 105, a back layer 104, a support 103, a recording layer 102 and a protective layer 101.

Figure 8:
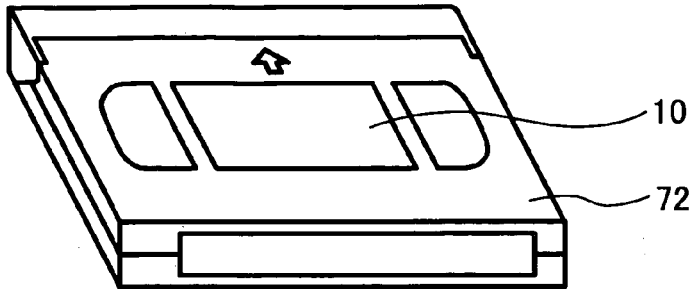
FIG. 8 is a schematic view illustrating a video cassette on which a label of the reversible thermosensitive recording medium of the present invention is attached.

FIG. 8 illustrates a video cassette 72 on which the recording label 10 is adhered. It is possible to automatically rewrite the displayed information in the recording label 10 when the information in the video cassette 72 is changed.

In the examples mentioned above, the recording label is adhered to the media such as cards, discs, disc cartridges, and cassettes, but the method of adhering the recording medium is not limited thereto. For example, a method in which the recording medium is directly formed on the media by coating; or a method in which a recording medium formed on a support is transferred on the media can also be used. When the transfer method is used, an adhesive layer (such as hot-melt type adhesive layers) may be previously formed on the recording medium.

When information is recorded in the recording medium, which is adhered to such hard media as mentioned above, using a thermal printhead is used, it is preferable to form a cushiony layer between the hard media and the recording layer to enhance the contact between the surface of the recording medium and the thermal printhead.

Figure 9:
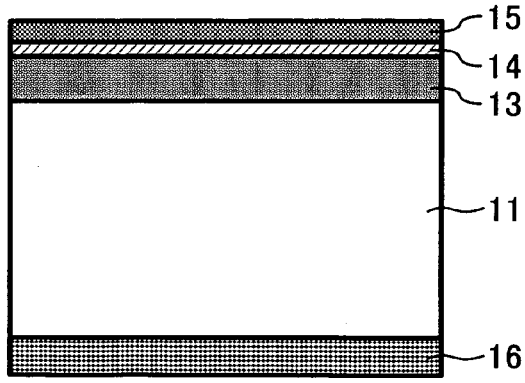
FIGS. 9 and 10 are schematic cross-sectional views of embodiments of the reversible thermosensitive recording medium of the present invention.
Figure 10:
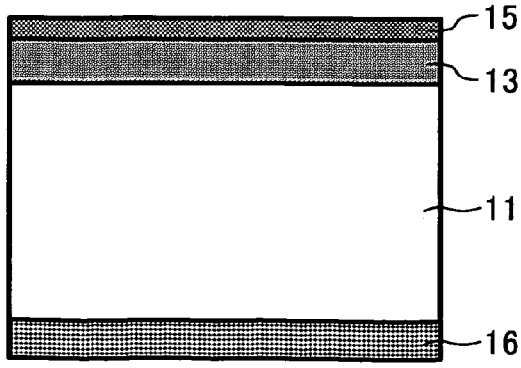

FIGS. 9 and 10 are schematic view illustrating the cross-section of embodiments of the recording medium of the present invention. In FIG. 9, a recording layer 13, an intermediate layer 14, and a protective layer 15 are formed on a substrate 11 and a back layer 16 is formed on the opposite side of the substrate 11. In FIG. 10, a recording layer 13, and a protective layer 15 are formed on a substrate 11 and a back layer 16 is formed on the opposite side of the substrate 11.

Figure 11A:
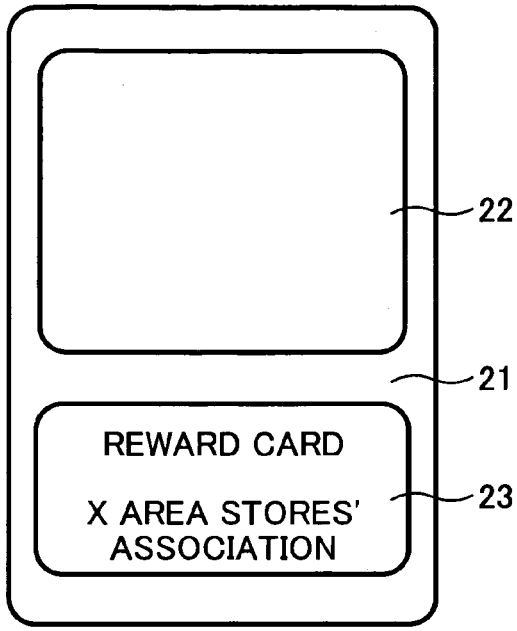
FIGS. 11A and 11B are schematic views of another embodiment (a card) of the reversible thermosensitive recording medium of the present invention.
Figure 11B:
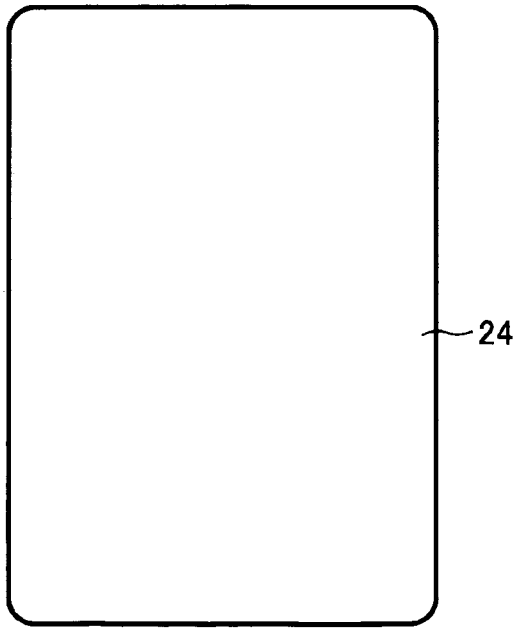

The recording medium having such a structure is preferably used for the industrial rewritable sheet having a RF-ID tag illustrated in FIG. 2. In addition, the recording medium can be preferably used for a card 21 having a print display portion 23 as illustrated in FIG. 11A. Numeral 22 denotes a rewritable display portion including the recording medium of the present invention. The backside of the card 21, which is illustrated in FIG. 11B, has a magnetic recording portion and a back layer 24 formed on the magnetic recording portion.

Figure 12A:
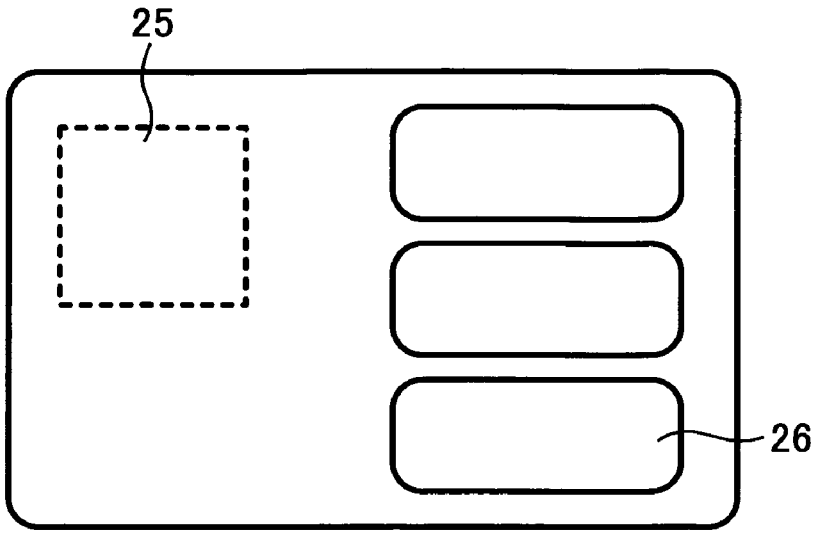
FIGS. 12A and 12B are schematic views of another card-form embodiment of the reversible thermosensitive recording medium of the present invention.
Figure 12B:
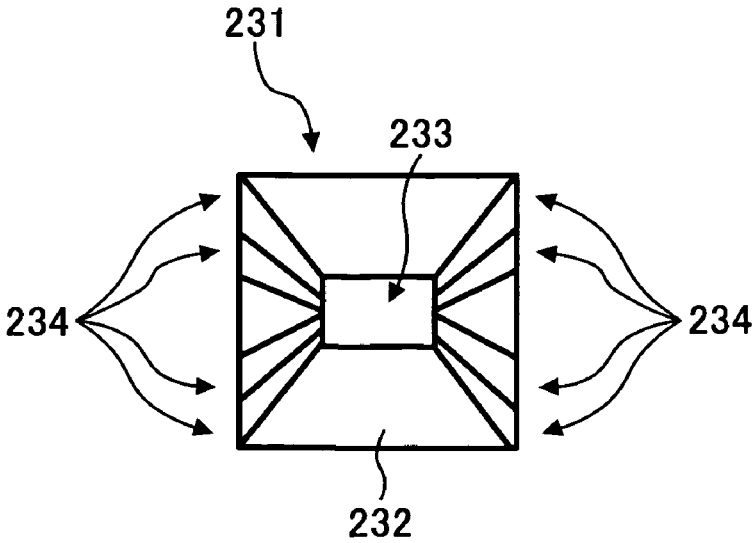

FIG. 12A illustrates an embodiment of the recording device (card) of the present invention. The recording device has a recording layer and a protective layer which are formed on a substrate. The recording device has a recessed portion 25, in which an IC chip is to be set, on the backside thereof, and a rewritable display portion 26 including the recording label of the present invention on the front side thereof. An embodiment of the IC chip to be set in the recessed portion 25 is illustrated in FIG. 12B. A wafer 231 includes a wafer substrate 232, and a integrated circuit 233 formed on the wafer substrate 232. A plurality of terminals 234 are provided on the backside of the wafer substrate 232. A printer (reader/writer) electrically contacts with the terminals 234 to read out or rewrite the information stored in the IC chip.

Figure 13A:
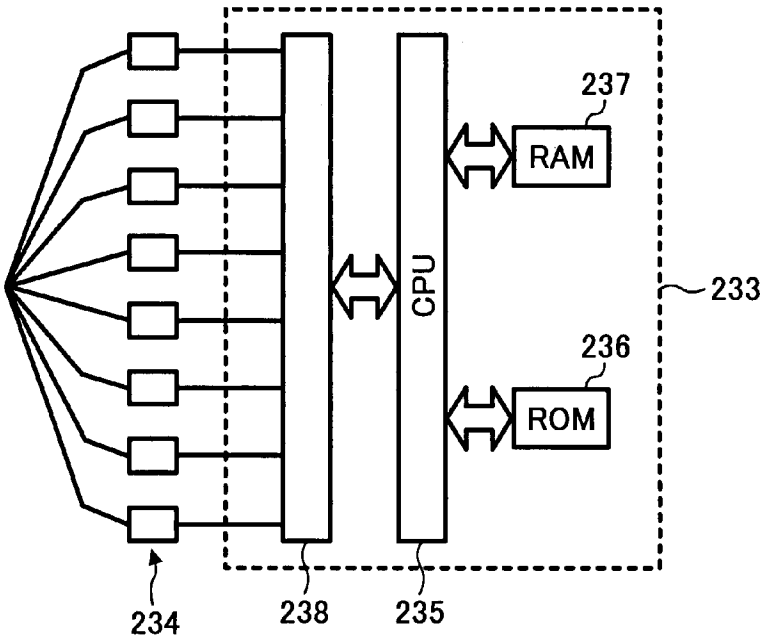
FIGS. 13A and 13B are a block diagram of an integrated circuit and a schematic view illustrating the information stored in the RAM of the integrated circuit.
Figure 13B:
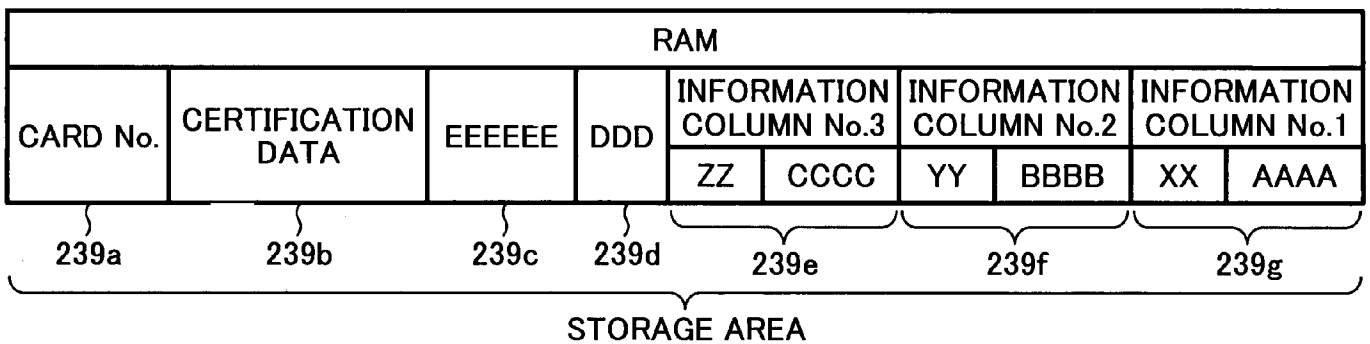

Then the function of the reversible thermosensitive recording will be explained referring to FIG. 13. FIG. 13A is a block diagram of the integrated circuit 233. FIG. 13B is a constitutional block diagram illustrating an embodiment of data stored in a RAM in the integrated circuit 233.

The integrated circuit 233 is constituted of, for example, a LSI including a CPU 235 which executes a controlling operation through a predetermined procedure, a ROM 236 which stores operational program data for the CPU 235, and a RAM 237 which writes and reads out data. In addition, the integrated circuit 233 has an input/output interface 238 which sends input data to the CPU 235 and outputs the signals output from the CPU 235. Further, the integrated circuit 233 has a power on reset circuit, a clock generation circuit, a pulse dividing circuit and an address decoder circuit, which are not shown.

The CPU 235 performs an interrupt control routine according to interrupt pulses provided by the pulse dividing circuit. The address decode circuit decodes the address data sent from the CPU 235, and sends signals to the ROM 236, RAM 237 and the input/output interface 238. The input/output interface 238 are connected with the plurality of terminals 234 (in FIG. 13, eight terminals). Data sent from a printer (reader/writer) is input to the CPU 235 via the terminals 234 and the input/output interface 238. When the CPU 235 receives the input signals, the CPU executes operations according to the program data stored in the ROM 236, and outputs data and signals to the reader/writer via the input/output interface 238.

As illustrated in FIG. 13B, the RAM 237 has a plurality of storage areas 239*a* to 239*g*. For example, the storage areas 239*a* and 239*b* store the card number, and data concerning the administrator of the card, respectively. The storage area 239*c* is a storage area to be used by the card owner or a storage area storing information on handling the card. The storage areas 239*d*, 239*e*, 239*f* and 239*g* store the former administrator and information concerning the former user, etc.

Image processing (i.e., image recording and/or erasing) can be performed on the reversible thermosensitive recording medium, label and device of the present invention by various image processing methods and apparatus. However, image processing can be preferably performed by the image processing apparatus mentioned below.

<Image Processing Method and Image Processing Apparatus>

The image processing apparatus of the present invention includes at least one of an image recording device configured to record an image and an image erasing device configured to erase an image in the recording medium of the present invention, and optionally includes other devices such as feeding devices and controlling devices.

The image processing method of the present invention includes at least one of the steps of erasing an image previously recorded in the recording medium and/or recording an image in the recording medium of the present invention, and optionally includes other steps such as feeding the recording medium and controlling the recording and/or erasing.

The image processing method of the present invention can be preferably performed using the image processing apparatus of the present invention. Namely, the image recording and erasing operations can be performed by the image recording device and the image erasing device, respectively, and the feeding operation and the controlling operation can be performed by the feeding device and the controlling device, respectively.

<Image Recording Device and Image Erasing Device>

The image recording device imagewise heats the recording medium to record an image therein. The image erasing device heats the recording medium to erase a former image recorded therein.

The image recording device for use in the present invention is not particularly limited, and heating devices such as thermal printheads, and laser beam emitting devices can be used. These devices can be used alone or in combination.

The image erasing device is not also particularly limited, and heating devices such as hot stamps, ceramic heaters, heat rollers, heat blocks, hot air blowers, thermal printheads, and laser beam emitting devices. Among these devices, ceramic heaters are preferably used because the image processing apparatus can be minimized in size, and the recording medium can achieve a good erased state, resulting in formation of a high contrast image. The temperature of the ceramic heater is not particularly limited, but is generally not lower than 110° C., preferably not lower than 112° C., and more preferably not lower than 115° C.

When a thermal printhead is used as an erasing device, the image processing apparatus can be further minimized and in addition energy can be saved. In addition, it is possible to perform image erasing and recording using only one thermal printhead. In this case, the image processing apparatus can be further minimized. When one thermal printhead is used for image erasing and recording, a method in which a previously recorded image is erased and then a new image is recorded; or a method (i.e., an overwriting method) in which a new image is recorded in parallel with erasing of a previously recorded image while the heating energy is changed for the image erasing and recording. The overwriting method has an advantages such that the time needed for the image erasing and recording operations can be shortened.

When the recording device of the present invention is used as a recording medium, the image processing apparatus can include an information reading device and an information rewriting device.

Suitable feeding devices for use in the image processing apparatus include known feeding devices which can feed the recording medium and/or the recording device of the present invention, such as feeding belts, feeding rollers, and combinations of feeding belts and feeding rollers.

Suitable controlling devices for use in the image processing apparatus include known controlling devices which can controlling the image erasing operation, image recording operation, feeding operation, etc., such as sequencers, and computers.

Then the image processing apparatus and image processing method will be explained referring to FIGS. 14 to 16.

Figure 14:
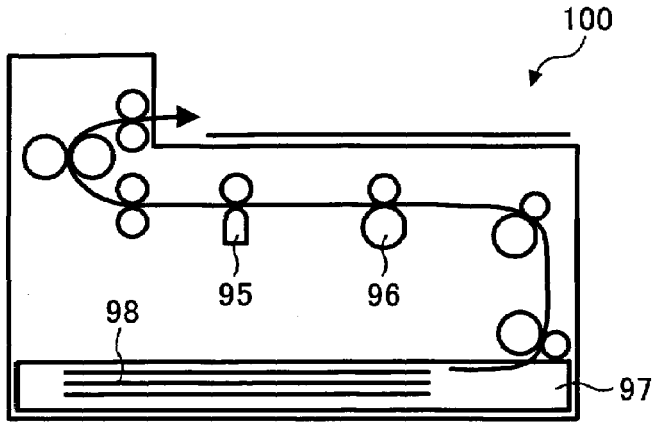
FIGS. 14 to 16 are schematic views illustrating embodiments of the image processing apparatus of the present invention.

Referring to FIG. 14, an image processing apparatus 100 includes a heat roller 96, a thermal printhead 95, a tray 97 containing sheets 98 of the recording medium of the present invention. The recording layer of the recording sheet 98, which is fed from the tray 97, is heated with the heat roller 96 to erase a former image recorded therein. Then a new image is recorded in the recording layer with the thermal printhead 95.

Figure 15:
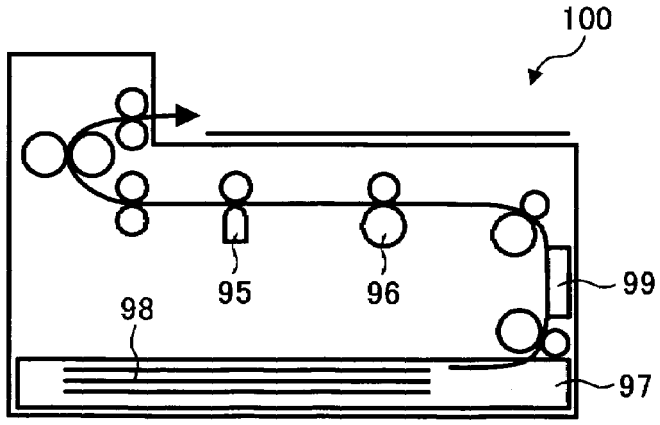
Figure 16:
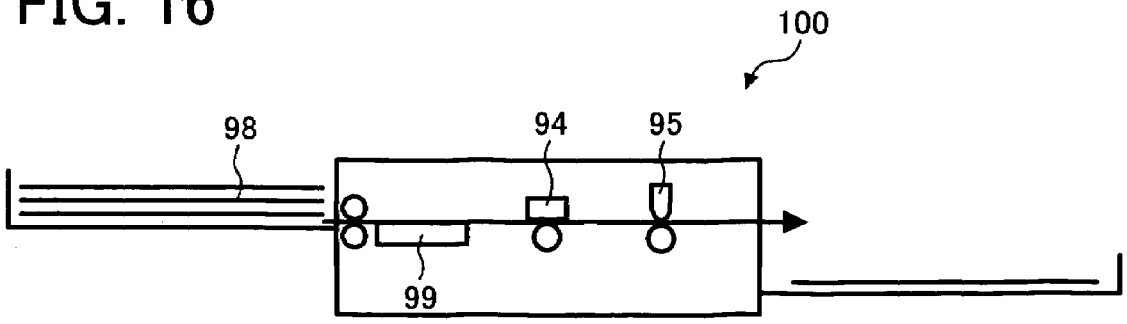

When a recording medium having a RF-ID tag is used, the image processing apparatus 100 can include a RF-ID reader/writer 99 as illustrated in FIGS. 15 and 16.

Referring to FIGS. 15 and 16, the reader/writer 99 of the image processing apparatus 100 reads the information stored in the RF-ID tag in the recording sheet 98, and then records new information therein. Then the heat roller 96 (or a ceramic heater 94 in FIG. 16) heats the recording layer of the recording sheet 98 to erase a former image recorded therein. Then the thermal printhead 95 records a new image in the recording layer of the recording sheet 98 according to the new information stored in the RF-ID tag.

It is possible to use a barcode reader or a magnetic head as the information reader instead of the RF-ID reader/writer 99. When a barcode reader is used, the barcode recorded in the recording layer in the recording sheet 98 is read with the barcode reader and then a new barcode image is recorded in the recording layer with the thermal printhead 95 according to the read information after the former barcode image and visual image are erased with the heat roller 96 (in FIG. 15) or the ceramic heater 94 (in FIG. 16).

The image processing apparatus 100 illustrated in FIGS. 14 and 15 has the tray 97 in which the recording sheets are stacked. The recording sheets 98 is fed one by one by a feeding method such as methods using a friction pad. The thus fed recording sheet is fed to the RF-ID reader/writer 99 by feeding rollers. The RF-ID reader/writer 99 reads and writes data in the RF-ID tag. Then the recording sheet 98 is fed to the heat roller 96 to erase the image recorded in the recording layer. Then the recording sheet is further fed to the thermal printhead 95 to record a new image information in the-recording layer. Then the recording sheet is discharged from the image processing apparatus. The temperature of the heat roller 96 is preferably from 110 to 190° C., more preferably from 110 to 180° C., and even more preferably from 115 to 170° C.

FIG. 17 illustrates another embodiment of the image processing apparatus of the present invention.

Figure 17A:
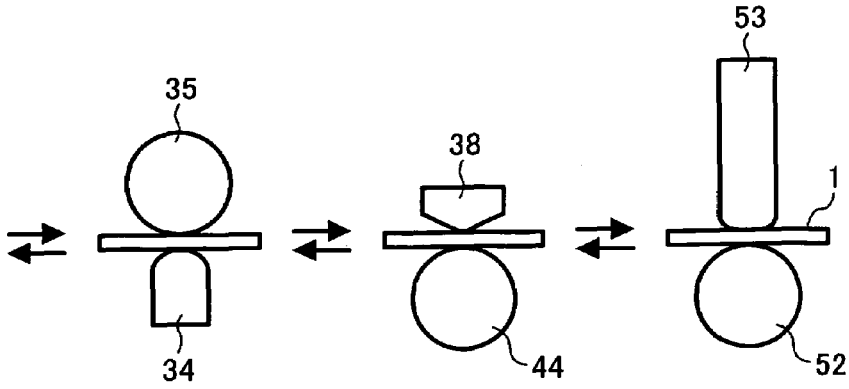
FIGS. 17A and 17B are schematic views of another embodiment of the image processing apparatus of the present invention, which uses a ceramic heater and a thermal printhead as the image erasing device and the image recording device, respectively.

An image processing device illustrated in FIG. 17A has a thermal printhead 53, a ceramic heater 38, a magnetic head 34, and feeding rollers 35, 44 and 52. At first, the information recorded in the magnetic recording layer of a sheet 1 of the recording medium is read with the magnetic head. Then the image previously recorded in the recording layer of the recording sheet 1 is erased with the ceramic heater 38. Further, new image data is recorded in the recording layer of the recording sheet 1 with the thermal printhead 53 on the basis of the information read by the magnetic head 34. Then the recording medium is discharged from the image processing apparatus. If desired, the recording sheet 1 may be returned to the magnetic head 34 to rewrite the information in the magnetic recording layer after the recording sheet passes the nip between the thermal printhead 53 and the feeding roller 52 and/or the nip between the ceramic heater 38 and the feeding roller 44. Thus, the recording sheet 1 can be fed forward and backward in the direction as indicated by arrows, as illustrated in FIG. 17A. Rewriting the information in the magnetic recording layer can be performed after the image recording operation or the image erasing operation.

Figure 17B:
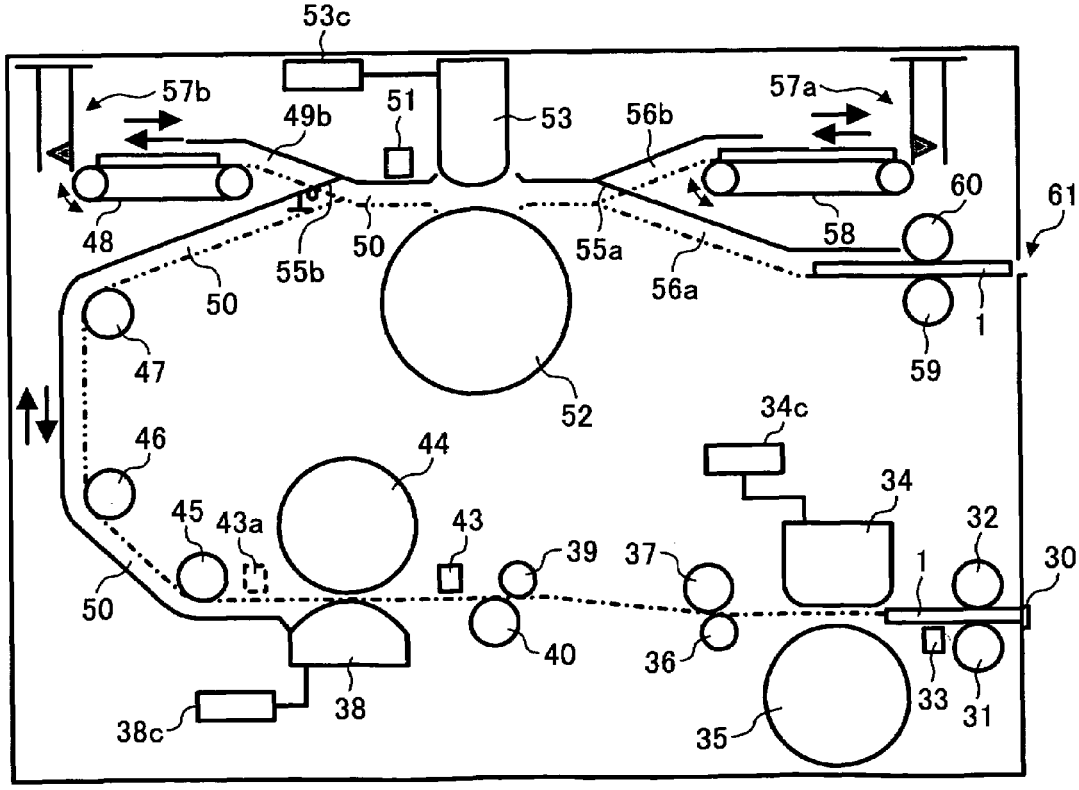

FIG. 17B illustrates another embodiment of the image processing apparatus of the present invention. A sheet 1 of the recording medium of the present invention, which is inserted from an entrance/exit 30, is fed into the apparatus by a feeding roller 31 and a guide roller 32. When the recording sheet 1 is detected and recognized with a sensor 33 and a controller 34*c*, the information is recorded in the magnetic recording layer or the information stored therein is erased with the magnetic head 34 while the recording sheet 1 is pressed by a platen roller 35. Then the recording sheet 1 is further fed by rollers 36 and 37 and rollers 39 and 40. When the recording sheet 1 is detected and recognized with a sensor 43 and a controller 38*c*, the ceramic heater 38 heats the recording layer of the recording sheet 1 to erase the former image therein. Then the recording sheet 1 is fed by rollers 45, 46 and 47 along a passage 50, as illustrated by a chain double-dashed line. When the recording sheet 1 is detected and recognized with a sensor 51 and a controller 53*c*, the thermal printhead 53 records a new image in the recording layer while the platen roller 52 presses the recording sheet 1 toward the thermal printhead 53. Then the recording sheet 1 is discharged by a feeding roller 59 and a guide roller 60 from the image processing apparatus through a passage 56*a* and an exit 61. In this case, the temperature of the ceramic heater 38 is preferably not lower than 110° C., more preferably not lower than 112° C., and even more preferably not lower than 115° C.

If desired, by changing the position of a passage changing member 55*a*, the recording sheet 1 can be guided to a passage 56*b*. When the recording sheet 1 presses a limit switch 57*a*, the recording sheet 1 is fed backward by a feeding belt 58 which can move in both directions as indicated by arrows. The thus reversely fed recording medium 1 is subjected to an image recording treatment at the nip between the thermal printhead 53 and the platen roller 52. By changing the position of a passage changing member 55*b*, the recording sheet 1 is guided to a passage 49*b*. When the recording sheet 1 presses a limit switch 57*b*, the recording sheet 1 is fed backward by a feeding belt 48 which can move in both directions as indicated by arrows. Then the recording sheet 1 is fed again through the passage 56*a* and discharged by the feeding roller 59 and the guide roller 60 from the exit 61. Such a branched passage and a passage changing member can be provided on the both sides of the ceramic heater 38. In such a case, it is preferable to provide a sensor 43*a* between the platen roller 44 and the feeding roller 45.

By using the image processing apparatus and method of the present invention and the recording medium of the present invention which has good erasability in a wide environmental condition range of from low temperature/low humidity condition to normal temperature/normal humidity condition, high contrast images can be recorded (i.e., rewritten) at a high speed.

Having generally described this invention, further understanding can be obtained by reference to certain specific examples which are provided herein for the purpose of illustration only and are not intended to be limiting. In the descriptions in the following examples, the numbers represent weight ratios-in parts, unless otherwise specified.

EXAMPLES

Example 1

<Preparation of Reversible Thermosensitive Recording Medium>

An opaque polyester film, TETORON U2L98W made by Teijin Du Pont which has a thickness of 188 μm, was used as the substrate.

(1) Preparation of Recording Layer

The following components were mixed and subjected to a pulverization treatment using a ball mill such that the solid components in the liquid have a particle diameter of from 1 to 4 μm.

| | |
|---|---|
| Color developer having the following formula | 4 parts |

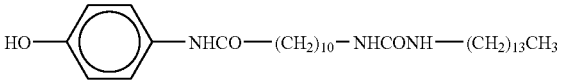

| | |
|---|---|
| Polyethylene glycol (number average molecular weight of 2,500) | 0.04 parts |
| Acrylic polyol resin (LR503 from Mitsubishi Rayon Co., Ltd., a solid content of 50% by weight) | 9 parts |
| Methyl ethyl ketone | 70 parts |

The thus prepared dispersion was mixed with 1 part of 2-anilino-3-methyl-6-diethylaminofluoran (i.e., a coloring agent) and 2 parts of 75% ethyl acetate solution of an adduct type hexamethylene diisocyanate (CORONATE HL from Nippon Polyurethane Industry Co., Ltd.) and the mixture was well agitated. Thus a recording layer coating liquid was prepared.

The recording layer coating liquid was coated on a surface of the substrate using a wire bar, and then dried for 2 minutes at 100° C., followed by heating at 60° C. for 24 hours. Thus, a recording layer having a thickness of about 8.0 μm was formed on the substrate.

(2) Preparation of Intermediate Layer

The following components were mixed well to prepare an intermediate layer coating liquid.

| | |
|---|---|
| Polyester polyol resin (TAKELAC U-21 from Takeda Chemical Industries, Ltd., 10% methyl ethyl solution) | 100 parts |
| Zinc oxide (from Sumitomo-Osaka Cement Co., Ltd.) | 10 parts |
| CORONATE HL (from Nippon Polyurethane Industry Co., Ltd.) | 15 parts |

The thus prepared intermediate layer coating liquid was coated on the recording layer using a wire bar, and then dried for 1 minute at 90° C., followed by heating at 60° C. for 2 hours. Thus, an intermediate layer having a thickness of about 2.0 μm was formed on the recording layer.

(3) Preparation of Protective Layer

The following components were mixed well to prepare protective layer coating liquid.

| | |
|---|---|
| Urethane-acrylate type ultraviolet crosslinking resin (C7-157 from Dainippon Ink and Chemicals Inc.) | 10 parts |
| Silica (P-527 from Muzusawa Industrial Chemicals Ltd.) | 1.5 parts |
| Ethyl acetate | 90 parts |

The thus prepared protective layer coating liquid was coated on the intermediate layer using a wire bar, and then fed at a speed of 12 m/min under an ultraviolet lamp having an irradiation energy of 80 W/cm to be crosslinked. Thus, a protective layer having a thickness of about 3 μm was formed on the intermediate layer.

Thus, a reversible thermosensitive recording medium of Example 1 was prepared.

Example 2

The procedure for preparation of the recording medium in Example 1 was repeated except that the added amount of the polyethylene glycol in the recording layer coating liquid was changed from 0.04 parts to 0.2 parts by weight.

Thus, a reversible thermosensitive recording medium of Example 2 was prepared.

Example 3

The procedure for preparation of the recording medium in Example 1 was repeated except that the polyethylene glycol in the recording layer coating liquid, which has a number average molecular weight of 2,500, was replaced with 0.2 parts by weight of a polyethylene glycol having a number average molecular weight of 6,000.

Thus, a reversible thermosensitive recording medium of Example 3 was prepared.

Example 4

The procedure for preparation of the recording medium in Example 1 was repeated except that the polyethylene glycol in the recording-layer coating liquid, which has a number average molecular weight of 2,500, was replaced with 0.2 parts by weight of a polyethylene glycol having a number average molecular weight of 20,000.

Thus, a reversible thermosensitive recording medium of Example 4 was prepared.

Example 5

The procedure for preparation of the recording medium in Example 1 was repeated except that the polyethylene glycol in the recording layer coating liquid, which has a number average molecular weight of 2,500, was replaced with 0.2 parts by weight of a polyethylene glycol having a number average molecular weight of 200,000.

Thus, a reversible thermosensitive recording medium of Example 5 was prepared.

Example 6

The procedure for preparation of the recording medium in Example 1 was repeated except that the polyethylene glycol in the recording layer coating liquid, which has a number average molecular weight of 2,500, was replaced with 0.2 parts by weight of a polyethylene glycol having a number average molecular weight of 5,000,000.

Thus, a reversible thermosensitive recording medium of Example 6 was prepared.

Example 7

The procedure for preparation of the recording medium in Example 1 was repeated except that the polyethylene glycol in the recording layer coating liquid, which has a number average molecular weight of 2,500, was replaced with 0.2 parts by weight of a polypropylene glycol having a number average molecular weight of 10,000.

Thus, a reversible thermosensitive recording medium of Example 7 was prepared.

Example 8

The procedure for preparation of the recording medium in Example 1 was repeated except that the polyethylene glycol in the recording layer coating liquid, which has a number average molecular weight of 2,500, was replaced with 0.2 parts by weight of a polytetramethylene glycol having a number average molecular weight of 4,000.

Thus, a reversible thermosensitive recording medium of Example 8 was prepared.

Example 9

The procedure for preparation of the recording medium in Example 1 was repeated except that the polyethylene glycol in the recording layer coating liquid, which has a number average molecular weight of 2,500, was replaced with 0.2 parts by weight of a polyethylene glycol monooleyl ether having a number average molecular weight of 4,500.

Thus, a reversible thermosensitive recording medium of Example 9 was prepared.

Example 10

The procedure for preparation of the recording medium in Example 1 was repeated except that the polyethylene glycol in the recording layer coating liquid, which has a number average molecular weight of 2,500, was replaced with 0.2 parts by weight of a polyethylene glycol monostearic acid ester having a number average molecular weight of 6,000.

Thus, a reversible thermosensitive recording medium of Example 10 was prepared.

Example 11

The procedure for preparation of the recording medium in Example 1 was repeated except that the formula of the dispersion used for the recording layer coating liquid was changed to the following.

| | |
|---|---|
| Color developer having the following formula | 4 parts |

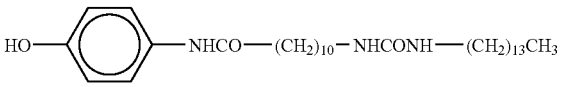

| | |
|---|---|
| Coloring/discoloring controlling agent ($C_{15}H_{33}CONHC_{18}H_{35}$) | 0.8 parts |
| Polyethylene glycol (number average molecular weight of 20,000) | 0.1 parts |
| Acrylic polyol resin (LR503 from Mitsubishi Rayon Co., Ltd., solid content of 50% by weight) | 9 parts |
| Methyl ethyl ketone | 70 parts |

Thus, a reversible thermosensitive recording medium of Example 11 was prepared.

Comparative Example 1

The procedure for preparation of the recording medium in Example 1 was repeated except that the polyethylene glycol was not included in the recording layer coating liquid.

Thus, a reversible thermosensitive recording medium of Comparative Example 1 was prepared.

Comparative Example 2

The procedure for preparation of the recording medium in Example 1 was repeated except that the polyethylene glycol in the recording layer coating liquid, which has a number average molecular weight of 2,500, was replaced with a polyethylene glycol having a number average molecular weight of 600.

Thus, a reversible thermosensitive recording medium of Comparative Example 2 was prepared.

Comparative Example 3

The procedure for preparation of the recording medium in Example 1 was repeated except that the polyethylene glycol in the recording layer coating liquid, which has a number average molecular weight of 2,500, was replaced with a polypropylene glycol having a number average molecular weight of 3,500.

Thus, a reversible thermosensitive recording medium of Comparative Example 3 was prepared.

Comparative Example 4

The procedure for preparation of the recording medium in Example 1 was repeated except that the polyethylene glycol in the recording layer coating liquid, which has a number average molecular weight of 2,500, was replaced with a polyethylene having a number average molecular weight of 5,000.

Thus, a reversible thermosensitive recording medium of Comparative Example 4 was prepared.

Comparative Example 5

The procedure for preparation of the recording medium in Example 1 was repeated except that the polyethylene glycol in the recording layer coating liquid, which has a number average molecular weight of 2,500, was replaced with a polycaprolactone having a number average molecular weight of 10,000.

Thus, a reversible thermosensitive recording medium of Comparative Example 5 was prepared.

The thus prepared recording media of Examples 1 to 11 and Comparative Examples 1 to 5 were evaluated as follows.

1. Erasing/Recording Test

Images were recorded in each recording medium using a thermal printing simulator made by Yashiro Seisakusho under the following conditions:

1) Environmental condition: 23° C. 50% RH.

2) Printing conditions

Recording head: Thermal printhead

Applied voltage: 18 V

Pulse width: 2 msec

The image density of the colored portion was measured with a densitometer MACBETH RD914 from Macbeth Co. This image density is defined as the "color density".

Then the recorded images were erased with the thermal printhead under the following erasing conditions.

Applied voltage: changed from 6 V to 13.5 V at an interval of 0.5 V

Pulse width: 6 msec

The minimum value of the color densities of the discolored states is defined as the "discolor density".

This erasing operation was performed under environmental conditions of 23° C. and 50% RH, 5° C. and 30% RH, and −5° C.

The results are shown in Table 1.

TABLE 1

| | 23° C. 50% RH | | 5° C. 30% RH | | −5° C. | |
|---|---|---|---|---|---|---|
| | Color density | Discolor density | Color density | Discolor density | Color density | Discolor density |
| Ex. 1 | 1.26 | 0.20 | 1.25 | 0.58 | 1.22 | 0.90 |
| Ex. 2 | 1.21 | 0.15 | 1.21 | 0.40 | 1.12 | 0.79 |
| Ex. 3 | 1.17 | 0.14 | 1.17 | 0.27 | 1.11 | 0.49 |
| Ex. 4 | 1.12 | 0.12 | 1.07 | 0.18 | 1.04 | 0.33 |
| Ex. 5 | 1.08 | 0.10 | 1.07 | 0.15 | 1.01 | 0.27 |
| Ex. 6 | 1.02 | 0.09 | 1.01 | 0.13 | 1.00 | 0.22 |
| Ex. 7 | 1.15 | 0.18 | 1.14 | 0.38 | 1.14 | 0.69 |
| Ex. 8 | 1.19 | 0.19 | 1.17 | 0.30 | 1.16 | 0.72 |
| Ex. 9 | 1.17 | 0.17 | 1.16 | 0.27 | 1.16 | 0.65 |
| Ex. 10 | 1.15 | 0.16 | 1.13 | 0.28 | 1.12 | 0.45 |
| Ex. 11 | 1.06 | 0.06 | 1.04 | 0.10 | 1.03 | 0.17 |
| Comp. Ex. 1 | 1.25 | 0.24 | 1.19 | 0.92 | 1.18 | 1.09 |
| Comp. Ex. 2 | 1.20 | 0.23 | 1.17 | 0.87 | 1.17 | 1.07 |
| Comp. Ex. 3 | 1.23 | 0.25 | 1.20 | 0.75 | 1.20 | 1.10 |
| Comp. Ex. 4 | 1.22 | 0.22 | 1.19 | 0.95 | 1.17 | 1.12 |
| Comp. Ex. 5 | 1.20 | 0.20 | 1.20 | 0.90 | 1.18 | 1.05 |

It is clear from Table 1 that by including a polyethylene glycol having a number average molecular weight not lower than 2,000 in the recording layer, the resultant recording media have a good erasability even under 5° C. 30% RH. In particular, the recording media of Examples 3 to 11 have good erasability even under −5° C.

EFFECTS OF THE PRESENT INVENTION

According to the present invention, high contrast images can be reversibly formed while previously formed images are erased at a high speed, under environmental conditions of from low temperature/low humidity conditions to normal temperature/normal humidity conditions.

This document claims priority and contains subject matter related to Japanese Patent Application No. 2004-059848, filed on Mar. 3, 2004, incorporated herein by reference.

Having now fully described the invention, it will be apparent to one of ordinary skill in the art that many changes and modifications can be made thereto without departing from the spirit and scope of the invention as set forth therein.

What is claimed is:

1. A reversible thermosensitive recording medium comprising:

a substrate; and a reversible thermosensitive recording layer located overlying the substrate and reversibly achieving a relatively colored state and a relatively discolored state depending on a temperature to which the recording layer is heated or a cooling speed at which the recording layer is cooled after heating, wherein the reversible thermosensitive recording layer comprises a polyalkylene glycol compound having a number average molecular weight not less than 2,000 exclusive of polypropylene glycol having a number average molecular weight not greater than 5,000.

2. The reversible thermosensitive recording medium according to claim 1, wherein the number average molecular weight of the polyalkylene glycol compound is from 2,000 to 6,000,000.

3. The reversible thermosensitive recording medium according to claim 1, wherein the number average molecular weight of the polyalkylene glycol compound is from 6,000 to 6,000,000.

4. The reversible thermosensitive recording medium according to claim 1, wherein the number average molecular weight of the polyalkylene glycol compound is from 15,000 to 6,000,000.

5. The reversible thermosensitive recording medium according to claim 1, wherein the polyalkylene glycol compound is a polyethylene glycol.

6. The reversible thermosensitive recording medium according to claim 1, wherein at least one end of the polyalkylene glycol compound is substituted with a group selected from the groups consisting of ether groups, ester groups and urethane groups.

7. The reversible thermosensitive recording medium according to claim 1, wherein the reversible thermosensitive recording layer further comprises one or more resins, and wherein the polyalkylene glycol compound is included in the reversible thermosensitive recording layer in an amount of from 0.1 to 50 parts by weight per 100 parts by weight of the one or more resins.

8. The reversible thermosensitive recording medium according to claim 1, wherein the reversible thermosensitive recording layer further comprises an electron donating compound and an electron accepting compound.

9. The reversible thermosensitive recording medium according to claim 8, wherein the electron accepting compound is a phenolic compound having the following formula (1):

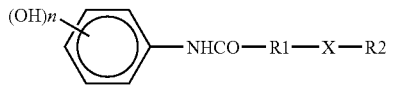

(1)

wherein n represents an integer of from 1 to 3; X represents a divalent group comprising at least one of a nitrogen atom and an oxygen atom; R1 represents an aliphatic hydrocarbon group having not less than 2 carbon atoms, which is optionally substituted; and R2 represents an aliphatic hydrocarbon group having 1 to 22 carbon atoms.

10. The reversible thermosensitive recording medium according to claim 9, wherein the group X is a urea group.

11. The reversible thermosensitive recording medium according to claim 1, wherein the reversible thermosensitive recording layer further comprises a discoloring accelerating agent having at least one of an amide group, a urethane group and a urea group.

12. The reversible thermosensitive recording medium according to claim 1, wherein the reversible thermosensitive recording layer further comprises a crosslinked resin.

13. The reversible thermosensitive recording medium according to claim 1, wherein the reversible thermosensitive recording medium has a form of a card, a label or a sheet.

14. The reversible thermosensitive recording medium according to claim 1, further comprising an adhesive layer which is located overlying a surface of the substrate opposite that bearing the reversible thermosensitive recording layer.

15. A reversible thermosensitive recording device comprising:

an information storage portion; and a reversible image displaying portion comprising the reversible thermosensitive recording medium according to claim 1.

16. The reversible thermosensitive recording device according to claim 15, wherein the information storage portion and the reversible image displaying portion are located overlying the substrate.

17. The reversible thermosensitive recording device according to claim 15, wherein the information storage portion comprises an information storage memory selected from the groups consisting of magnetic recording layers, magnetic recording stripes, IC memories, optical memories, Radio Frequency Identification tag cards, disks, disc cartridges and tape cassettes.

18. An image processing method, comprising at least one of the following steps:

heating the reversible thermosensitive recording layer in the reversible thermosensitive recording medium according to claim 1 to erase a first image in the recording layer; and imagewise heating the reversible thermosensitive recording layer to record a second image therein.

19. The image processing method according to claim 18, wherein the image recording is performed by a thermal printhead or a laser irradiating device.

20. The image processing method according to claim 18, wherein the image erasing is performed by a device selected from the group consisting of thermal printheads, ceramic heaters, heat rollers, hot stamps, heat blocks and laser irradiating devices.

21. The image processing method according to claim 18, wherein the imagewise heating is performed with a thermal printhead while the heating for erasing is performed with the thermal printhead.

* * * * *